US007283145B2

(12) United States Patent
Kato et al.

(10) Patent No.: US 7,283,145 B2
(45) Date of Patent: Oct. 16, 2007

(54) IMAGE HEATING APPARATUS AND HEATER THEREFOR

(75) Inventors: Akira Kato, Mishima (JP); Hiroaki Sakai, Mishima (JP); Masafumi Maeda, Odawara (JP); Seietsu Miura, Odawara (JP); Hiroshi Takami, Odawara (JP); Tomoyuki Makihira, Ashigarashimo-Gun (JP); Atsushi Iwasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 11/154,545

(22) Filed: Jun. 17, 2005

(65) Prior Publication Data

US 2005/0280682 A1 Dec. 22, 2005

(30) Foreign Application Priority Data

Jun. 21, 2004 (JP) ..... 2004-182418
Jun. 21, 2004 (JP) ..... 2004-182419

(51) Int. Cl.
*G03G 15/20* (2006.01)

(52) U.S. Cl. ..... 347/156; 219/216; 399/328

(58) Field of Classification Search ..... 347/155, 347/156, 212; 399/328
See application file for complete search history.

(56) References Cited

U.S. PATENT DOCUMENTS 5,149,941 A 9/1992 Hirabayashi et al. ..... 219/216
5,300,997 A 4/1994 Hirabayashi et al. ..... 355/285
5,343,280 A 8/1994 Hirabayashi et al. ..... 355/285
5,663,696 A 9/1997 Morgan ..... 355/285
5,682,576 A 10/1997 Sakai et al. ..... 399/69
5,767,484 A 6/1998 Hirabayashi et al. ..... 219/216
5,802,421 A 9/1998 Miura ..... 399/33
5,904,871 A 5/1999 Sakai et al. ..... 219/216
6,151,462 A 11/2000 Fukuzawa et al. ..... 399/67
6,175,699 B1 1/2001 Kato et al. ..... 399/69
6,336,009 B1 1/2002 Suzumi et al. ..... 399/67
6,438,348 B2 8/2002 Kobaru et al. ..... 399/333
6,516,165 B2 2/2003 Makihira et al. ..... 399/69
6,734,397 B2 5/2004 Kato et al. ..... 219/216
6,947,679 B2 9/2005 Kato et al. ..... 399/45
2003/0077092 A1 4/2003 Ogawa et al. ..... 399/328
2004/0131374 A1 7/2004 Sakai ..... 399/68

(Continued)

FOREIGN PATENT DOCUMENTS

JP 63-313182 12/1988

(Continued)

*Primary Examiner*—Huan Tran
(74) *Attorney, Agent, or Firm*—Fitzpatrick, Cella, Harper & Scinto

(57) ABSTRACT

The n image heating apparatus for heating an image formed on a recording material, includes a heater including a substrate, and plural heat generating resistors formed on the substrate along a longitudinal direction thereof, and plural switching elements connected electrically between a power source and the plural heat generating resistors, wherein the plural heat generating resistors include at least two first heat generating resistors driven by a first switching element and at least a second heat generating resistor driven by a second switching element, and the second heat generating resistor is provided between the at least two first heat generating resistors in a direction of a shorter side of the substrate. In this manner there can be provided an image heating apparatus with a heater of an excellent durability, and a heater adapted for use in such apparatus.

13 Claims, 20 Drawing Sheets

U.S. PATENT DOCUMENTS

| | | | | |
|---|---|---|---|---|
| 2005/0214044 | A1 | 9/2005 | Sakakibara et al. | 399/333 |
| 2005/0258158 | A1 | 11/2005 | Takami et al. | 219/216 |
| 2005/0280682 | A1 | 12/2005 | Kato et al. | 347/102 |
| 2006/0000819 | A1 | 1/2006 | Makihira et al. | 219/216 |
| 2006/0024071 | A1 | 2/2006 | Takami | 399/33 |
| 2006/0045589 | A1 | 3/2006 | Iwasaki et al. | 399/328 |
| 2006/0067750 | A1 | 3/2006 | Inoue et al. | 399/328 |
| 2006/0188280 | A1* | 8/2006 | Hayakawa et al. | 399/68 |
| 2007/0059008 | A1* | 3/2007 | Iwasaki et al. | 399/68 |

FOREIGN PATENT DOCUMENTS

| | | |
|---|---|---|
| JP | 10-177319 | 6/1998 |
| JP | 2000-162909 | 6/2000 |
| JP | 2000-250337 | 9/2000 |
| JP | 2001-228731 | 8/2001 |

* cited by examiner

FIG. 18

| | | HEATER BREAKDOWN TIME | SAFETY ELEMENT OPERATING TIME | RESULT |
|---|---|---|---|---|
| MAIN HEATING MEMBER (UNABLE TO CONTROL) | COMPARATIVE EXAMPLE | 3.5 | NO-GO | NG |
| | THIS EMBODIMENT | 10.0 | 5.8 | 4.2 SEC MARGIN |
| SUB-HEATING MEMBER (UNABLE TO CONTROL) | COMPARATIVE EXAMPLE | 3.5 | NO-GO | NG |
| | THIS EMBODIMENT | 6.0 | 5.6 | 0.4 SEC MARGIN |

RESISTIVITY
MAIN 18 Ω/SUB 18 Ω
INPUT VOLTAGE 140V

FIG. 20

| | | HEATER BREAKDOWN TIME | SAFETY ELEMENT OPERATING TIME | MARGIN |
|---|---|---|---|---|
| MAIN HEATING MEMBER (UNABLE TO CONTROL) | 1:1 | 10.0 | 5.8 | 4.2 SEC |
| | 3:2 | 8.2 | 4.6 | 3.6 SEC |
| SUB-HEATING MEMBER (UNABLE TO CONTROL) | 1:1 | 6.0 | 5.6 | 0.4 SEC |
| | 3:2 | 9.6 | 6.8 | 2.8 SEC |

RESISTIVITY
1:1···MAIN 18 Ω/SUB 18 Ω
3:2···MAIN 14.5 Ω/SUB 23 Ω
INPUT VOLTAGE 140V

| | | HEATER BREAKDOWN TIME | SAFETY ELEMENT OPERATING TIME | RESULT |
|---|---|---|---|---|
| MAIN HEATING MEMBER (UNABLE TO CONTROL) | EMBODIMENT 1 | 8.2 | 4.6 | 3.6 SEC |
| | EMBODIMENT 2 | 9.0 | 3.4 | 5.6 SEC |

RESISTIVITY
MAIN 14.5 Ω
INPUT VOLTAGE 140V

IMAGE HEATING APPARATUS AND HEATER THEREFOR

BACKGROUND OF THE INVENTION

1. Field of the Invention

The present invention relates to an image heating apparatus adapted for use as a heat fixing apparatus in a copying machine or a printer, and a heater adapted for use in such image heating apparatus.

2. Description of the Related Art

In a heat fixing apparatus for a copying machine or a printer, there is commercialized an apparatus of a configuration having, as disclosed in Japanese Patent Application Laid-open No. S63-313182, a flexible sleeve, a ceramic heater in contact with an internal surface of the flexible sleeve, and a pressure roller constituting a nip portion with the ceramic heater through the flexible sleeve, in which a recording material bearing a toner image is conveyed by the nip portion to heat fixing the toner image onto the recording material. Such heat fixing apparatus (called film heating type), having a very low heat capacity, has advantages of a quick warning up to a fixable temperature thereby providing a short print waiting time, and a low electric power consumption in a stand-by state waiting for a print command.

The flexible sleeve is made of polyimide or stainless steel. Also the ceramic heater is formed by printing a heat-generating resistor principally constituted of silver or palladium on a plate-shaped ceramic substrate excellent in heat resistance, thermal conductivity and electrical insulation such as of alumina or aluminum nitride. A temperature of the heater is controlled by controlling a current supply to the heat-generating resistor, based on a temperature detected by a thermistor maintained in contact with the ceramic heater.

Such fixing apparatus, though being excellent in the quick-starting property because of its low heat capacity, is associated with drawbacks because of such low heat capacity. In case the longitudinal length of the recording material is relatively short in comparison with the longitudinal length of the heater, an amount of heat taken away from the heater is different significantly, in the nip portion, between a sheet passing area passed by the recording material and a sheet non-passing area not passed by the recording material, so that the temperature of the sheet non-passing area, where the heat is not taken away by the recording material, is gradually elevated as the sheets are passed one by one. Thus there tends to result a temperature elevation phenomenon in the sheet non-passing area, which becomes more marked in the film heating system of low heat capacity. Since an excessive temperature elevation phenomenon in the sheet non-passing area causes a thermal deterioration of the components of the fixing apparatus thereby leading to a reduction in the service life of the apparatus, there have been proposed a heater configuration and a control method for the fixing apparatus for solving such drawbacks.

Japanese Patent Application Laid-open No. 2000-162909 proposes a method of reducing the aforementioned temperature elevation in the sheet non-passing area, utilizing a heater 700 of a structure as shown in FIG. 12A. Also FIG. 13A shows a heater driving circuit 70.

A heater 700 shown in FIG. 12A is provided with plural heat generating patterns 701*a*, 701*b* having different heat generating areas in the longitudinal direction of a ceramic substrate 704, and also with current-supplying electrodes 702*a*, 702*b* and a common electrode 703 for independent current supplies to the heat-generating patterns.

A heater driving circuit 70 shown in FIG. 13A is an example of a driving circuit for controlling the current supply to the heater 700. A thermistor 50 is contacted with the heater 700 or provided in the vicinity thereof, and supplies a CPU 71 with a detection result of the temperature of the heater 700. The CPU 71 controls turn-on timings of triacs 72*a*, 72*b* so as to execute a desired temperature control, based on the temperature detection result by the thermistor 50. The CPU 71 is capable of determine a turn-on ratio of the triacs 72*a*, 72*b* and can execute the temperature control with a desired heat generation ratio. Also a safety element 60 (temperature fuse or thermo switch) for preventing an excessive temperature elevation of the heater 700 is provided serially in the current supply line and is contacted with the heater 700 or provided in the vicinity thereof, and such safety element 60 is activated in a thermal uncontrollable state of the heater 700 to cut off the power supply to the heater 700.

In the fixing apparatus equipped with the heater 700 of FIG. 12A and having a reference position of sheet passing at the center of the longitudinal direction, in case of fixing a recording material of a relatively large longitudinal length (hereinafter called large-sized sheet), a current is given between the electrodes 702*b* and 703 to heat the heat generating pattern 701*b*, and in case of fixing a recording material of a relatively small longitudinal length (hereinafter called small-sized sheet), a current is given between the electrodes 702*a* and 703 to heat the heat generating pattern 701*a*, thereby reducing the temperature evaluation in the sheet non-passing area.

Also Japanese Patent Application Laid-open No. 2000-250337 proposes a similar heater configuration, in which three heat-generating patterns are independently activated as shown in FIG. 12B. In this case, a heater 800 is provided on a ceramic substrate 804, heat-generating patterns 801*a*, 801*b*, 801*c*, current-supplying electrodes 802*a*, 802*b*, 802*c* and a common electrode 803 and is driven by a heater driving circuit 75 shown in FIG. 13B, whereby each heat-generating pattern can be independently activated.

Also Japanese Patent Application Laid-open No. H10-177319 proposes a fixing apparatus employing a heater capable of forming an arc-shaped heat generation distribution by a multi-step heat generation control according to various sheet sizes, thereby suppressing the temperature elevation in the sheet non-passing area within a certain range while securing the fixing property.

A heater 900 shown in FIG. 12C is provided with plural heat generating patterns 901*a*, 901*b* having different heat generating distributions in the longitudinal direction of a ceramic substrate 904, and also with current-supplying electrodes 902*a*, 902*b* and a common electrode 903 for independent current supplies to the heat-generating patterns. The heat generating pattern 901*a* has a width which is widened in plural steps from an approximate center in the longitudinal direction toward end portions to reduce the resistance per unit length, thereby providing a convex heat generation distribution with a peak heat generation at the center of the longitudinal direction under a current supply, while the heat generating pattern 901*b* has a width which is made narrower from the approximate center in the longitudinal direction toward end portions to increase the resistance per unit length, thereby providing a concave heat generation distribution with a bottom heat generation at the center of the longitudinal direction under a current supply.

With the heater 900, a smooth slope can be obtained in the heat generation distribution in the longitudinal direction, by incorporating the heater 900 in a heater driving circuit 70 shown in FIG. 13A and executing a control with a turn-on ratio of the triacs 72*a*, 72*b* determined by a CPU 71. In the fixing apparatus equipped with such heater 900 and having a reference position of sheet passing at the center of the longitudinal direction, it is possible to control the temperature elevation in the sheet non-passing area and the fixing property at the same time in more strict manner, by selecting the turn-on ratio of the triacs 72*a*, 72*b* within a range from 10:10 to 10:0 according the longitudinal length of the recording material.

However, in such fixing apparatus of film heating type utilizing such ceramic heater, in so-called uncontrollable situation of the fixing apparatus caused for example by a failure of the triac therein, the heater may show an excessive temperature increase and the ceramic substrate may be cracked by a thermal stress applied to the heater before the safety element (temperature fuse or thermo switch) can function. Also depending on the manner of cracking of the ceramic substrate, a dielectric strength cannot be satisfied between a resistance circuit (AC) side (primary side) including the heat generating pattern and a temperature sensor circuit (DC) side (secondary side) for heater temperature detection and the secondary circuit may be destructed by a current leaking to the main body of the image forming apparatus equipped with the fixing apparatus.

A thermal stress $\sigma$ applied to a cross section of the substrate is represented, in case the temperature distribution is symmetrical within the cross section of the substrate, by a linear thermal expansion coefficient $\epsilon$ and a Young's modulus E of the substrate and a temperature difference $\Delta T$ within the substrate, which is dependent on the thermal conductivity thereof, by a following equation:

$$\sigma=\epsilon \cdot E \cdot \Delta T$$

However, in case the temperature distribution is asymmetrical, it no longer is simply proportional to the temperature difference $\Delta T$ because a bending moment is applied to the substrate, and the tensile stress generally becomes larger at the bending side of the substrate. A breakage occurs when such tensile stress exceeds the bending strength (breaking strength) of the substrate.

For example, in case of a heater bearing a heat-generating pattern along the longitudinal direction on a surface of an alumina substrate having a length of 370 mm, a width of 10 mm and a thickness of 1 mm, a largest thermal stress is known to occur in a cross section in the direction of width (shorter side) of the substrate. Therefore, the breakage of the heater by the thermal stress can be considered to depend largely on the temperature distribution in the direction of width (shorter side) of the substrate.

In a heater with prior plural drives, namely in a heater in which plural heat generating patterns are independently driven by plural triacs, in case of a thermal uncontrollable of the heater by a failure in a triac, the temperature distribution increases asymmetry in the cross section in the direction of width of the substrate, and a margin to the heater breakage is limited because of a strong tensile stress functioning at the same time.

For example, in the heater 700 shown in FIG. 12A, since the heat generating pattern 701*a* is formed in an asymmetric area with respect to an approximate center CL in the direction of width (shorter direction) of the substrate (hereinafter represented as approximate shorter side center of the substrate), a failure in the triac 72*a* shown in FIG. 13A induces a large asymmetry in the temperature distribution in the cross section in the direction of width of the substrate, thereby showing a limited margin for the breakage.

In the heater 800 shown in FIG. 12B, though the entire heat generating patterns are formed symmetrically with respect to the approximate shorter side center CL of the substrate, since each heat generating pattern can be driven independently, a failure in the triac 77*a* or 77*b* shown in FIG. 13B induces a large asymmetry in the temperature distribution, thereby showing a limited margin to the breakage.

Also in the heater 900 shown in FIG. 12C, though the entire heat generating patterns are formed symmetrically with respect to the approximate shorter side center CL of the substrate, a thermal uncontrollable in one of the heat generating patterns 901*a*, 901*b* induces a large asymmetry, thereby showing a limited margin to the breakage.

SUMMARY OF THE INVENTION

The present invention has been made in consideration of the aforementioned drawbacks, and an object thereof is provide an image heating apparatus having an excellent durability of a heater, and a heater to be employed in such apparatus.

Another object of the present invention is to provide an image heating apparatus of which a heat generation distribution in the shorter side direction of the heater is more symmetrical than in the prior technology, with respect the center in the shorter side direction of the substrate, and a heater to be employed in such apparatus.

Still another object of the present invention is to provide an image heating apparatus including:

a heater including a substrate and a plurality of heat generating resistors formed on said substrate along a longitudinal direction thereof; and a plurality of switching elements connected electrically between a power source and said plurality of heat generating resistors;

wherein said plurality of heat generating resistors include at least two first heat generating resistors driven by a first switching element and at least one of a second heat generating resistor driven by a second switching element, and said second heat generating resistor is provided between said first heat generating resistors in a direction of a shorter side of said substrate.

Still another object of the present invention is to provide a heater including:

a substrate; and a plurality of heat generating resistors formed on said substrate along a longitudinal direction thereof;

wherein said plurality of heat generating resistors include at least two first heat generating resistors driven by a first switching element of the image heating apparatus and at least one of a second heat generating resistor driven by a second switching element of the image heating apparatus, and said second heat generating resistor is provided between said first heat generating resistors in a direction of a shorter side of said substrate.

Still other objects of the present invention will become fully apparent from the following detailed description, which is to be taken in conjunction with the accompanying drawings.

BRIEF DESCRIPTION OF THE DRAWINGS

FIG. 18 is a table showing a time to destruction and an operation time of a safety element in heaters with a same resistance in heat generating resistors;

FIG. 20 is a table showing a time to destruction and an operation time of a safety element in heaters with different resistances in heat generating resistors;

DETAILED DESCRIPTION OF THE PREFERRED EMBODIMENTS

In the following examples of the present invention will be explained with reference to the accompanying drawings.

EXAMPLE 1

(1) Example of Image Forming Apparatus

Figure 11:
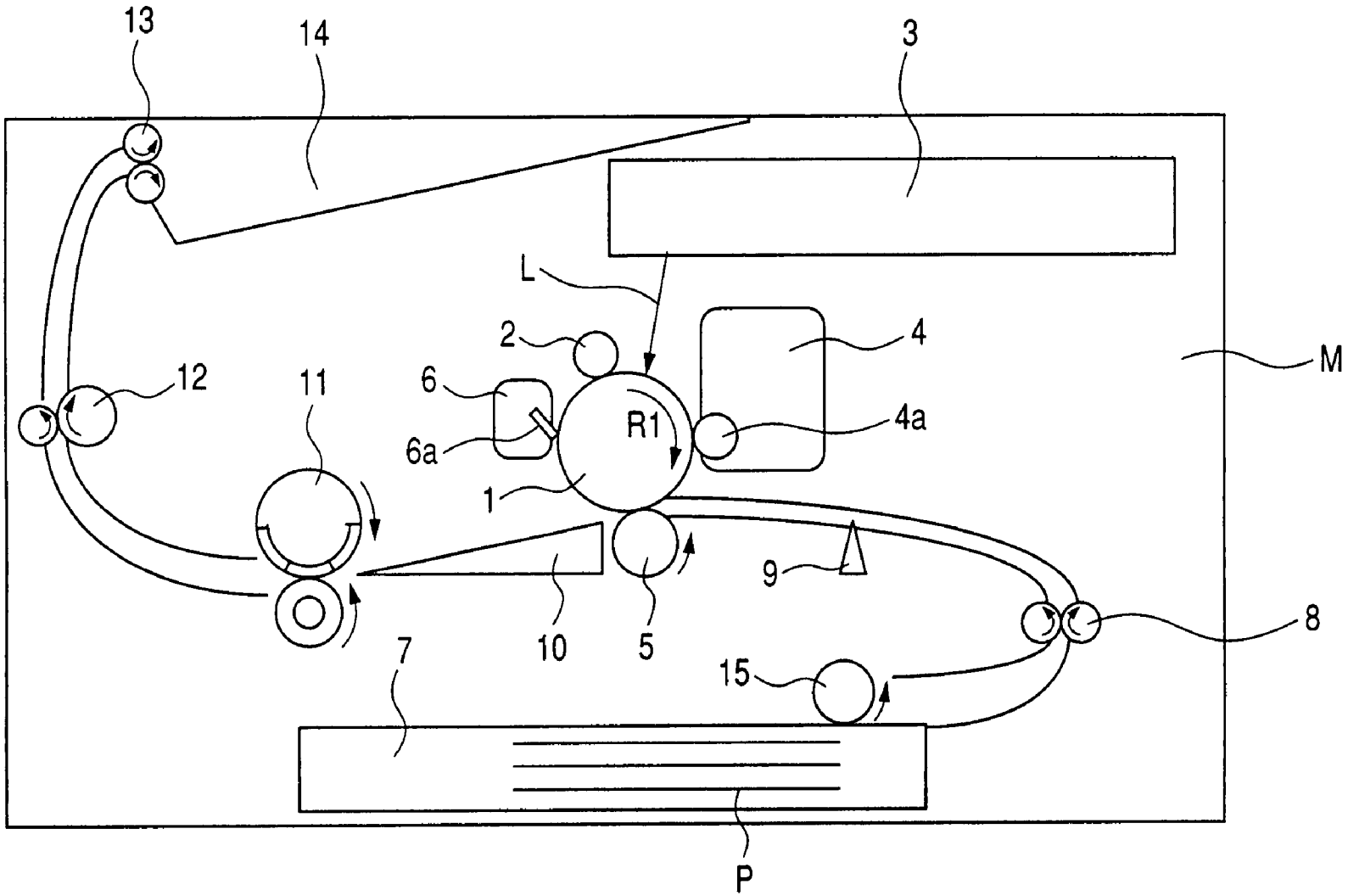
FIG. 11 is a schematic view showing a configuration of an image forming apparatus provided with an image heating apparatus of the present invention.

FIG. 11 shows an image forming apparatus equipped with an image heating-fixing apparatus (hereinafter represented as fixing apparatus) as an image heating apparatus of the present invention. The image forming apparatus shown therein is a laser beam printer utilizing an electrophotographic process.

The image forming apparatus is provided with an electrophotographic photosensitive member of drum shape (hereinafter represented as photosensitive drum) as an image bearing member. The photosensitive drum 1 is rotatably supported in a main body M of the apparatus, and is rotated at a predetermined process speed in a direction R1 by drive means (not shown).

Around the photosensitive drum 1 and along a rotating direction thereof, there are provided in succession a charging roller (charging apparatus) 2, exposure means 3, a developing apparatus 4, a transfer roller (transfer apparatus) 5 and a cleaning apparatus 6.

In a lower part of the main body M of the apparatus, there is provided a sheet cassette 7 containing sheet-shaped recording material P such as paper as the recording material, and along a conveying path of the recording material P and in succession from the upstream side, there are provided a sheet feeding roller 15, conveying rollers 8, a top sensor 9, a conveying guide 10, a fixing apparatus 11 containing a heater of the invention, conveying rollers 12, sheet discharge rollers 13 and a sheet discharge tray 14.

In the following, functions of the image forming apparatus of the above-described configuration will be explained.

The photosensitive drum 1, rotated in the direction R1 by the drive means (not shown), is uniformly charged by the charging roller 2 at a predetermined polarity and at a predetermined potential.

The photosensitive drum 1 after charging is subjected, by exposure means 3 such as a laser optical system, to an image exposure L based on image information, whereby a charge in an exposed portion is eliminated and an electrostatic latent image is formed.

The electrostatic latent image is developed by the developing apparatus 4. The developing apparatus 4 is provided with a developing roller 4*a*, which is given a developing bias and deposits a toner onto the electrostatic latent image on the photosensitive drum 1 thereby developing it into a toner image (visible image).

The toner image is transferred by the transfer roller 5 onto the recording material P such as paper. The recording material P is contained in the sheet cassette 7, and is fed and conveyed by the feeding roller 15 and the conveying rollers 8, through the top sensor 9, to a transfer nip portion between the photosensitive drum 1 and the transfer roller 5. In this operation, the recording material P is detected at a front end thereof by the top sensor 9 and is thus synchronized with the toner image on the photosensitive drum 1. The transfer roller 5 is given a transfer bias, by which the toner image on the photosensitive drum 1 is transferred onto a predetermined position on the recording material P.

The recording material P, bearing thereon the transferred and unfixed toner image, is conveyed along the conveying guide 10 to the fixing apparatus 11, in which the unfixed toner image is fixed by heat and pressure onto the surface of the recording material P. The fixing apparatus 11 will be explained later in more details.

The recording material P after the toner image fixation is conveyed by the conveying rollers 12 and discharge rollers 13 and discharged onto the discharge tray 14 provided on an upper surface of the main body M of the apparatus.

On the other hand, the photosensitive drum 1 after the toner image transfer is subjected to a removal of a toner that has not been transferred onto the recording material P but remains on the surface (hereinafter represented as transfer residual toner), by a cleaning blade 6*a* of the cleaning apparatus 6 and is thus prepared for a next image formation.

Image formations can be executed by repeating the aforementioned process.

(2) Fixing Apparatus 11

Figure 1:
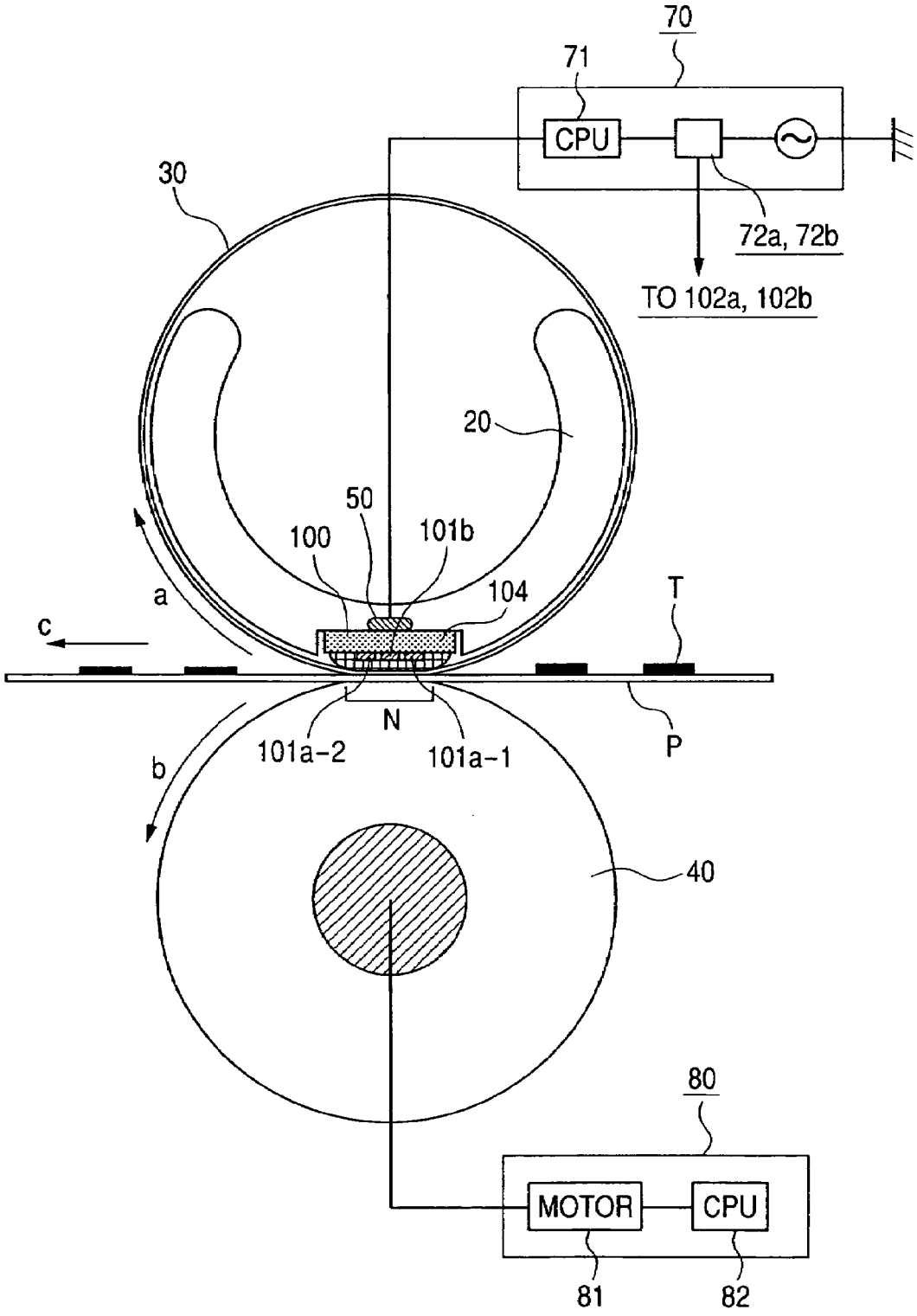
FIG. 1 is a schematic cross-sectional view of a fixing apparatus of the present invention.

FIG. 1 is a schematic cross-sectional view of a fixing apparatus of film heating type, based on the present invention.

The fixing apparatus 11 of the present example is a pressure roller driving type, in which a heater support member 20 supporting a heater 100 is pressed to a pressure roller 40, constituting a pressure member, under a predetermined pressure through a cylindrical heat-resistant film 30 serving as a flexible sleeve, thereby forming a fixing nip portion N between the pressure roller and the heater 100.

When the pressure roller 40 is rotated in a direction b by a rotation control unit 80, the heat-resistant film 30 rotates, by a friction with the pressure roller 40, in a direction a around the external periphery of the heater support member 20 supporting the heater 100. On the other hand, a power supply to the heater is controlled by a heater driving circuit 70 in such a manner that a temperature detected by a temperature detector 50 maintains a target temperature, whereby the heater is maintained at about the target temperature. In such state, the recording material P bearing the unfixed toner image T is conveyed in the fixing nip portion N in a direction c, whereby the heat of the heater 100 is given through the heat-resistant film to the recording material P and the unfixed toner image T is thermally fixed onto the recording material P. The recording material P after passing the fixing nip portion N is separated by a curvature from the heat-resistant film 30 and discharged. In the present example, the passing of the recording material P is executed on a reference position at the center of the longitudinal direction (perpendicular to the conveying direction c of the recording material P) of each member.

The heater 100 is prepared by forming, on an oblong heat-resistant substrate 104 such as of alumina, three heat-generating patterns (heat generating resistors) 101*a* (101*a*-1 and 101*a*-2) and 101*b*, and a surface protective layer 106 for covering these resistors. The heater 100 will be explained in more details in following (3).

The cylindrical heat-resistant film 30 is a thin film tube having a polyimide base layer of a thickness of about 30-100 μm, and a coating of PFA or PTFE is provided across a primer layer on the base layer for providing a releasing property to the toner. Also grease (not shown) is coated between the internal surface of the film 30 and the heater support member 20 in order to secure a sliding property of the film 30.

The pressure roller 30 is a rotary member constituted by forming, on a metal core, an elastic layer such as of silicone rubber and further forming a releasing layer of FEP or PFA of thickness of about 10-100 μm across a primer layer, thereby securing a releasing property to the toner.

The heater support member 20 is formed by a heat-resistant resin having a heat insulating property, a high heat resistance and a rigidity such as polyphenylene sulfide (PPS), polyamidimide (PAI), polyimide (PI), polyether ether ketone (PEEK) or a liquid crystal polymer, or a composite material of such resin and ceramics, metal or glass.

The rotation control unit 80 is provided with a motor 81 for rotating the pressure roller 40, and a control unit (CPU) 82 for controlling the rotation of the motor 81. The motor 81 can be, for example, a DC motor or a stepping motor.

(3) Heater 100

Figure 2A:
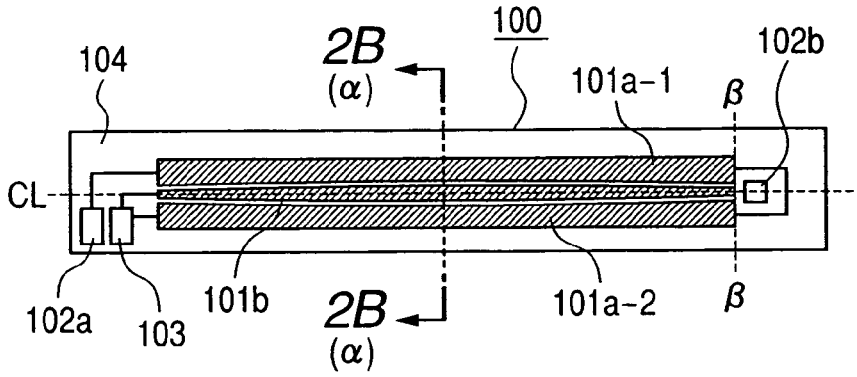
FIGS. 2A and 2B are schematic views showing a configuration of a heater 100 in Example 1.
Figure 2B:
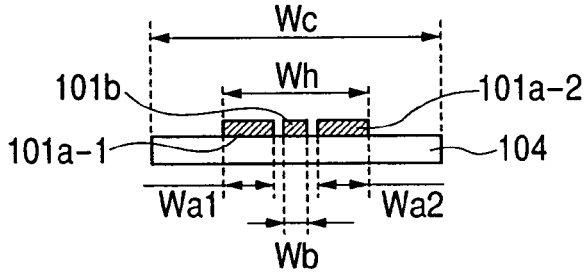

FIGS. 2A and 2B are schematic views of a heat generating pattern bearing surface of the heater 100 and a cross section in the direction of width of the substrate.

The heater 100 is provided, on a surface of an oblong substrate 104 of a ceramic material having a high heat resistance, a electrical insulating property and a low heat capacity such as alumina or aluminum nitride (alumina in the present example 1) for example of a length of 370 mm, a width of 10 mm and a thickness of 1 mm, heat generating patterns 101*a* (101*a*-1, 101*a*-2) and 101*b* such as of Ag/Pd, and current feeding electrodes 102 (102*a*, 102*b*) and a common electrode 103 as electrode patterns for power supply to the heat generating patterns 101. The two heat generating patterns 101*a* (101*a*-1, 101*a*-2) (first heat generating resistors) are driven by a first switching element to be explained later, and the heat generating pattern 101*b* (second heat generating resistor) is driven by a second switching element to be explained later. The heat generating patterns 101*a* (101*a*-1, 101*a*-2) are driven (on/off controlled) by the first switching element and always execute heat generation at the same time.

In the following there will be explained detailed configuration of the heat generating patterns 101*a*-1 and 101*a*-2.

The heat generating patterns 101*a*-1, 101*a*-2 (first heat generating resistors), capable of passing a current from a current supply electrode 102*a* provided at a longitudinal end of a surface of the substrate to the common electrode 103, are provided at an end side and another end side in the direction of width (shorter side) of the substrate as shown in FIG. 2A, and the heat generating patterns 101*a*-1, 101*a*-2 are respectively provided along the longitudinal direction of the substrate 104. The heat generating patterns 101*a*-1, 101*a*-2 are serially connected to constitute a first conductive path, and are formed in substantially symmetrical areas with respect to the approximate shorter side center CL of the substrate. Also each of the heat generating patterns 101*a*-1, 101*a*-2 is widened in the pattern width in the shorter side direction in plural steps from approximate center to both ends in the longitudinal direction to gradually reduce the resistance per unit length in the longitudinal direction, thereby providing, when a current is passed, a peaked heat generating distribution (hereinafter also called "convex type heat generation pattern") having a peak of heat generation at a reference position, namely at the approximate center, in the longitudinal direction of the substrate 104. In the heat generating patterns 101*a*-1, 101*a*-2 of the present example, the pattern widths thereof are so regulated that a resistance per unit length in the longitudinal direction of the substrate in the vicinity of a line α-α at about the longitudinal center in FIG. 2A is 1.2 times of a resistance per unit length in the longitudinal direction in the vicinity of a line β-β close to the end portion.

The heat generating pattern 101*b* (second heat generating resistor), capable of passing a current from a current supply electrode 102*b* provided at a longitudinal end of a surface of the substrate to the common electrode 103, is provided, in the direction of width of the substrate, between the heat generating patterns 101*a*-1, 101*a*-2 (inner position than the first conductive path on the substrate) and constitutes a second conductive path along the longitudinal direction of the substrate 104. Also the heat generating pattern 101*b* is formed in substantially symmetrical areas with respect to the approximate shorter side center CL of the substrate. The heat generating pattern 101*b* is made narrower in the pattern width in the shorter side direction in plural steps from approximate center to both ends in the longitudinal direction to gradually increase the resistance per unit length in the longitudinal direction, thereby providing, when a current is passed, a concave heat generating distribution (hereinafter also called "concave type heat generation pattern") having a bottom of heat generation at the approximate center. In the heat generating pattern 101*b* of the present example, the pattern width thereof is so regulated that a resistance per unit length in the longitudinal direction of the substrate in the vicinity of a line β-β at about the longitudinal center in FIG. 2A is 1.2 times of a resistance per unit length in the longitudinal direction in the vicinity of a line α-α close to the end portion.

Also the heat generating patterns 101*a* and 101*b* are set at a resistance of Ra=20 Ω(Ra1=Ra2=10 Ω because of serial connection) and Rb=20 Ω, so that each heat generating pattern generates a power of 720 W under an application of 120 V. With such resistance setting, each heat generating pattern can be prepared with a same composition by selecting the pattern widths, on a line α-α, for example Wa1=Wa2=1.6 mm, Wb=0.8 mm and a pattern gap of 0.5 mm.

Also as shown in FIG. 2B, an area Wh of the heat generating patterns 101*a* and 101*b* is formed substantially symmetrically to the short side center CL of the heater substrate 104, with such a width as to be contained in the fixing nip N. In the present example, there are selected Wc=10 mm and Wh=5 mm.

Figure 3:
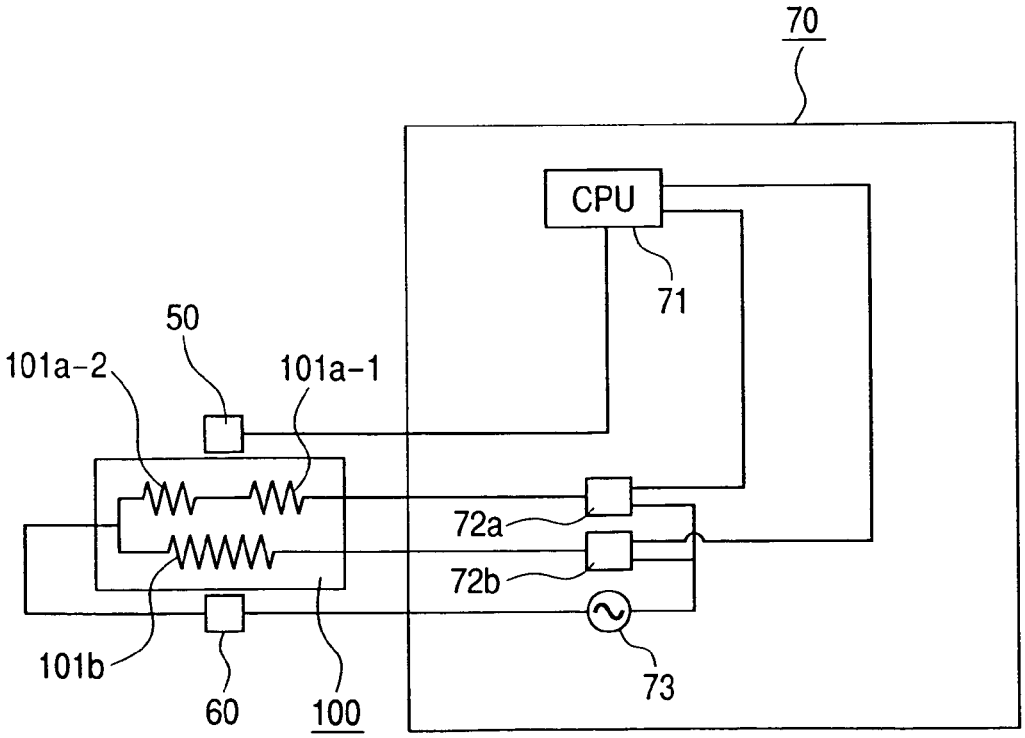
FIG. 3 is a circuit diagram showing a heater driving circuit employing the heater 100 in Example 1.

FIG. 3 shows a drive circuit 70 for controlling the current supply to the heater 100. A thermistor 50 as a temperature detector is provided in contact with the heater 100 or in the vicinity thereof, and supplies the controller (CPU) 71 with a result of temperature detection. For achieving a desired temperature control, the CPU 71 controls, based on the result of temperature detection by the thermistor 50, a triac 72*a* (first switching element) and a triac 72*b* (second switching element) connected between a commercial power supply 73 and the first and second heat generating resistors. The CPU 71 is capable of determining a driving ratio of the triacs 72*a*, 72*b*, namely a heating generation ratio of the first heat generating resistors and the second heat generating resistor, thereby executing the temperature control with a desired heat generation ratio. For example, the CPU 71 sets the heating generation ratio of the first heat generating resistors and the second heat generating resistor in accordance with a size of the recording material. A power control of the heater 100 by the heater driving circuit 70 is conducted by a multi-step power control method such as a zero-cross wave number control in which the power supply is turned on or off at each half cycle of the power supply wave form or a phase control in which a phase angle of current supply is controlled in each half cycle of the power supply wave form.

Also a safety element 60 (temperature fuse or thermo switch) for preventing the excessive temperature elevation of the heater 100 is connected serially in the current supply line and is positioned in contact with the heater 100 or close thereto. In case of a thermal uncontrollable state of the heater 100 for example by a failure of the triac 72*a* or 72*b*, the safety element is activated in response to the heat of the heater 100 thereby terminating the current supply to the heater 100. The fixing apparatus of the present example employs a thermo switch CH-16 (manufactured by Wako Electronic Co., rated operation temperature: 250° C.) as the safety element 60. This thermo switch 60 is identified, in a preliminary testing, to function within a time of 10±1 seconds in case a uncontrollable state is caused by a failure of a triac (namely disabled temperature management by the CPU 71) and a power of 980 W (application of a voltage of 140 V to the resistor of 20 Ω), for example in case a power is continuously supplied without the temperature control to the heater from a state of normal temperature (24° C.).

Figure 4A:
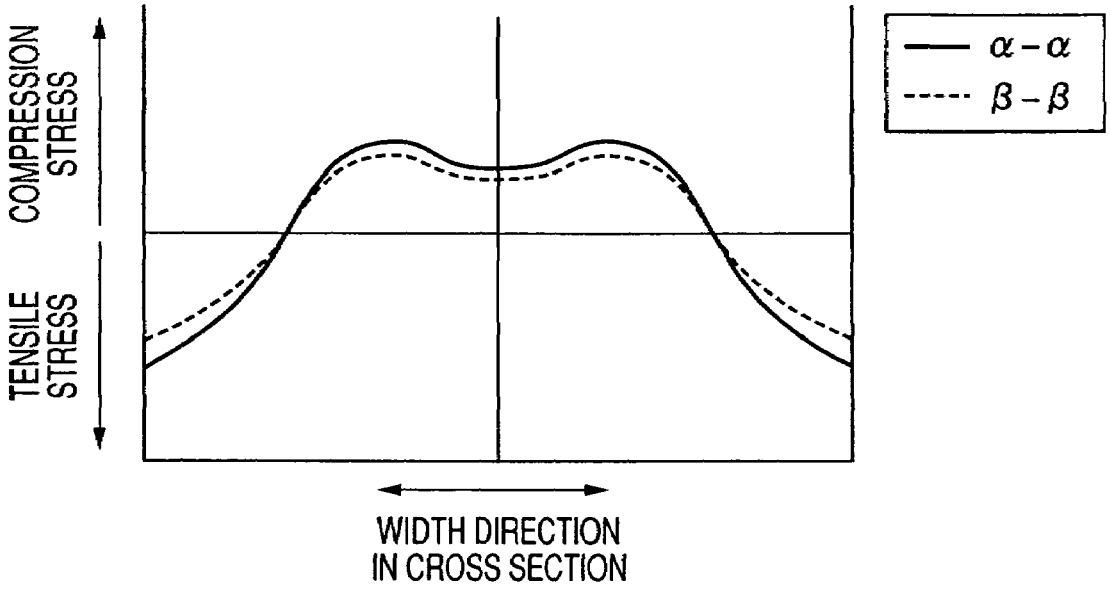
FIGS. 4A and 4B are charts showing thermal stress distribution in a thermal uncontrollable state in Example 1.
Figure 4B:
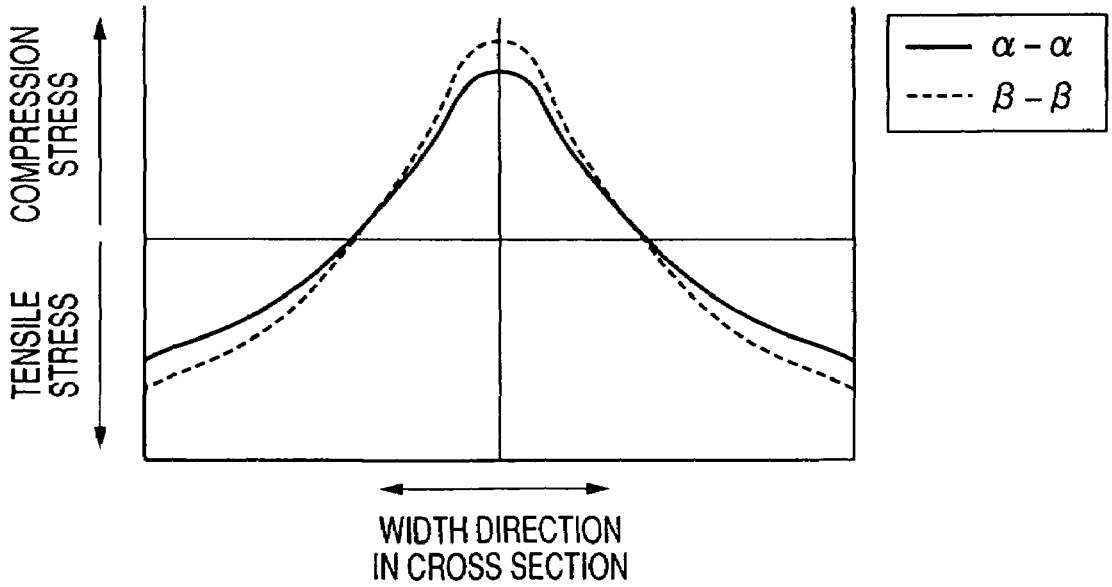

FIGS. 4A and 4B show a thermal stress distribution in the cross section in the direction of width of the heater 100, in case of a thermal uncontrollable state of the heater 100 in the fixing apparatus of the present example, caused by a failure in one of the triacs 72*a* and 72*b*.

The present example employs an alumina substrate 104 of a linear expansion coefficient $\epsilon=7.2\times10^{-6}$/° C., a Young's modulus E=340 GPa and a bending strength of 400 MPa. Each thermal stress distribution shows a state after 3 seconds from the start of a thermal uncontrollable state caused by a failure of a triac in the course of current supply (application of a voltage of 140 V) to the heat generating resistors, and, in each chart, an upper part shows a compression stress and a lower area shows a tensile stress. As explained in the foregoing, a magnitude of the tensile stress is related with the breakage and a larger absolute value of the tensile stress results in a smaller margin to the breakage and a shorter time to the breakage.

At first, in case of a thermal uncontrollable of the convex type heat generating patterns 101*a* (first heat generating resistors) by a failure of the triac 72*a*, the absolute tensile stress became maximum at both ends of the α-α cross section in FIG. 2A and reached 106 MPa after 3 seconds from the start of application of 140 V. Such stress is about 1.2 times of the maximum tensile stress at the β-β cross section. In the absence of the thermo switch 60, a heater breakage occurs from the edge portion of the substrate at the α-α cross section. According to a verification of the inventors, in case the current supply is continued to the heat generating patterns 101*a* without the temperature control from a normal temperature (24° C.) of the heater, the heater shows a breakage after 16 seconds. As explained in the foregoing, the thermo switch 60 functions within a time of 10±1 seconds in case the power is continuously supplied to the heater from a state of normal temperature (24° C.), so that, even when a thermal uncontrollable state is induced by a failure of the triac 72*a* in the fixing apparatus of the example 1, the thermo switch 60 functions in time to terminate the current supply to the heater thereby avoiding the breakage thereof.

Also in case of a thermal uncontrollable of the concave type heat generating pattern 101*b* by a failure of the triac 72*b*, the absolute tensile stress became maximum at both ends of the β-β cross section in FIG. 2A and reached 172 MPa after 3 seconds from the start of application of 140 V. Such stress is about 1.2 times of the maximum tensile stress at the α-α cross section. In the absence of the thermo switch 60, a heater breakage occurs from the edge portion of the substrate at the β-β cross section. According to a verification of the inventors, in case the current supply is continued to the heat generating pattern 101*b* without the temperature control from a normal temperature (24° C.) of the heater, the heater shows a breakage after 12 seconds. Thus, even when a thermal uncontrollable state is induced by a failure of the triac 72*b* in the fixing apparatus of the example 1, the thermo switch 60 functions in time to terminate the current supply to the heater thereby avoiding the breakage thereof.

Figure 12A:
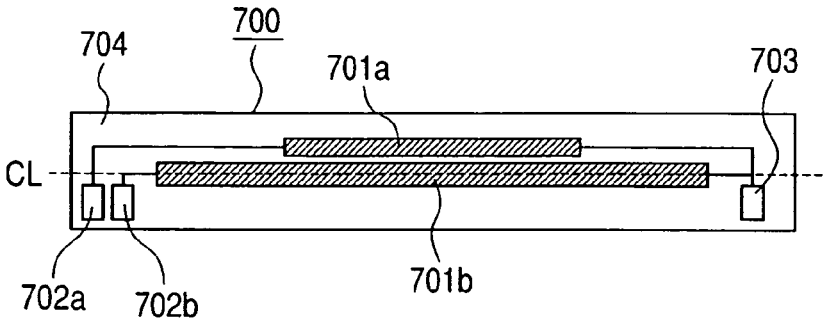
FIGS. 12A, 12B, 12C and 12D are views showing heater configurations in comparative examples.
Figure 12B:
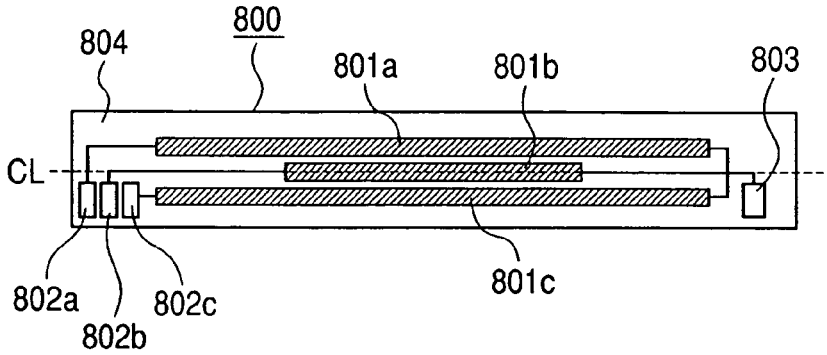
Figure 12C:
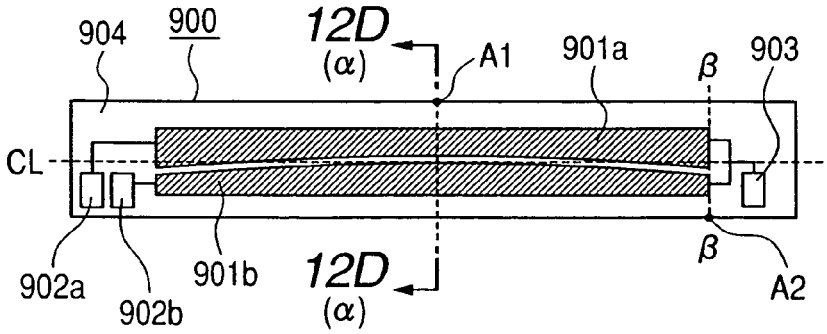

Now a heater 900 shown in FIG. 12C will be explained as a comparative example. As shown in FIG. 12C, the heater 900 is provided, on a surface of a substrate 904, heat generating patterns 901*a* and 101*b* such, current feeding electrodes 902*a*, 902*b* and a common electrode 903. The heat generating pattern 901*a* is controlled by a first triac 72*a*, and the heat generating pattern 901*b* is controlled by a second triac 72*b*.

The heat generating pattern 901*a* is a single heat generating resistor capable of passing a current from the current supplying electrode 902*a* to the common electrode 903, and is widened in the pattern width in plural steps from approximate center to both ends in the longitudinal direction to gradually reduce the resistance per unit length in the longitudinal direction, thereby constituting a convex type heat generation pattern. In FIG. 12C, a resistance per unit length in the longitudinal direction in the vicinity of a line α-α in FIG. 2C is 1.2 times of a resistance per unit length in the longitudinal direction in the vicinity of a line β-β.

The heat generating pattern 901*b* is a single heat generating resistor capable of passing a current from the current supplying electrode 902*b* to the common electrode 903, and is made narrower in the pattern width in plural steps from approximate center to both ends in the longitudinal direction to gradually increase the resistance per unit length in the longitudinal direction, thereby constituting a concave type heat generation pattern. In FIG. 12C, a resistance per unit length in the longitudinal direction in the vicinity of a line β-β in FIG. 2C is 1.2 times of a resistance per unit length in the longitudinal direction in the vicinity of a line α-α.

The heat generating patterns 901*a* and 901*b* are set at a resistance of Ra=20 Ω and Rb=20 Ω, so that each heat generating pattern generates a power of 720 W under an application of 120 V. With such resistor setting, each heat generating pattern can be prepared with a same composition by selecting the pattern widths, on a line α-α in FIG. 12D, for example Wa=2 mm, Wb=2.4 mm and a pattern gap of 0.6 mm.

Figure 12D:
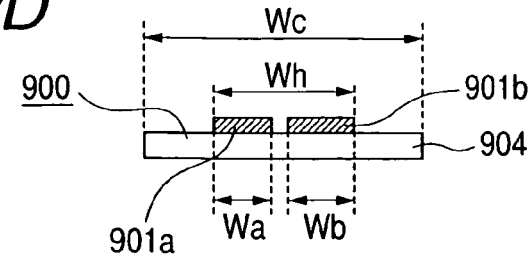

Also as shown in FIG. 12D, an area Wh of the heat generating patterns 101*a* and 101*b* is formed substantially symmetrically to the short side center CL of the heater substrate 904, with such a width as to be contained in the fixing nip N. In the present example, there are selected Wc=10 mm and Wh=5 mm.

Figure 13A:
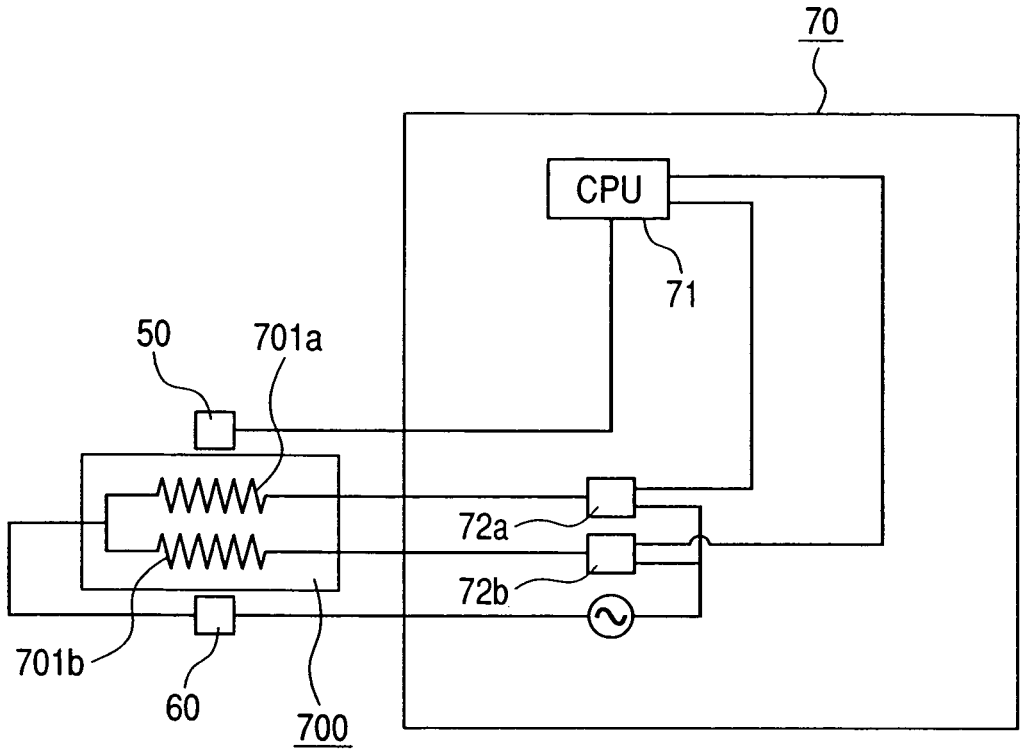
FIGS. 13A and 13B are circuit diagrams showing heater driving circuits of comparative examples.
Figure 13B:
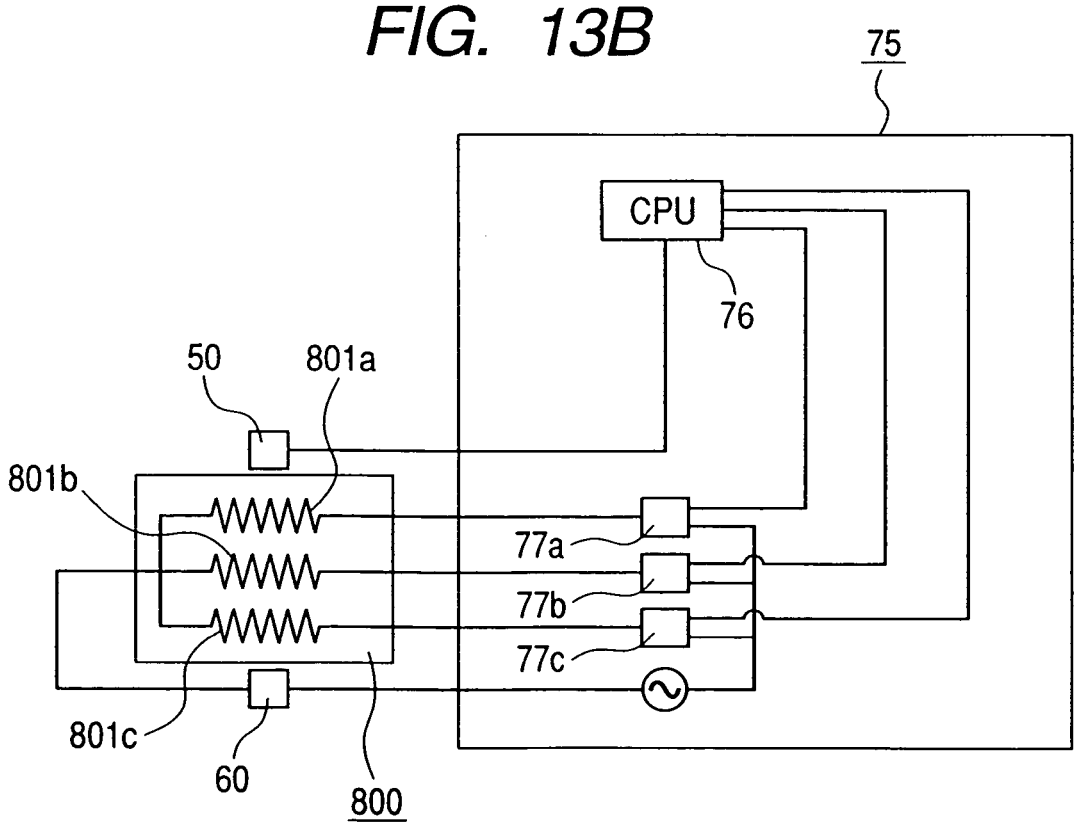
Figure 14A:
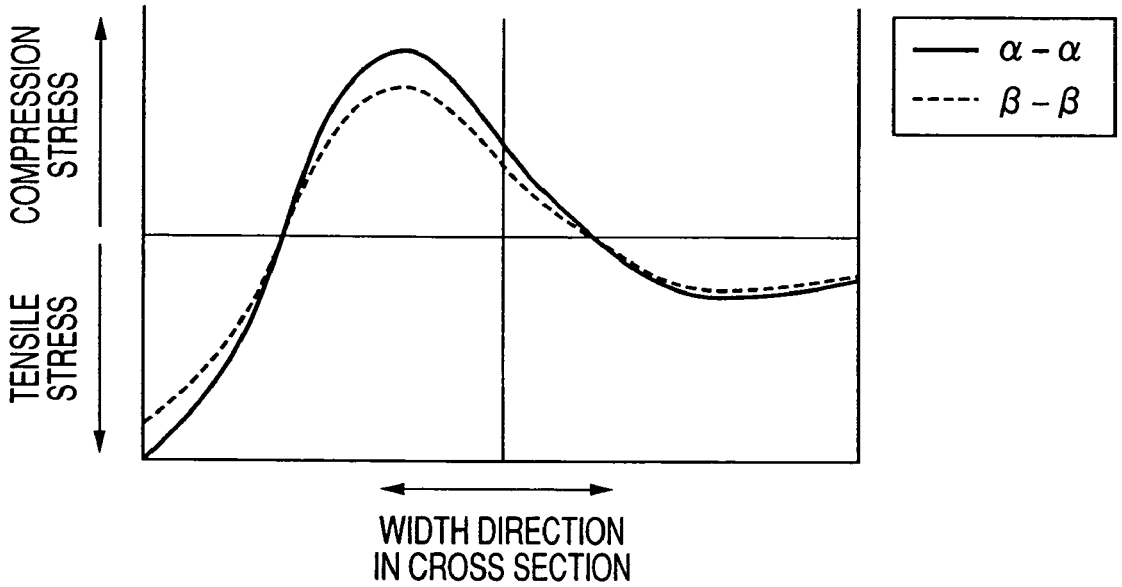
FIGS. 14A and 14B are charts showing thermal stress distribution in a thermal uncontrollable state in the heaters of comparative examples.
Figure 14B:
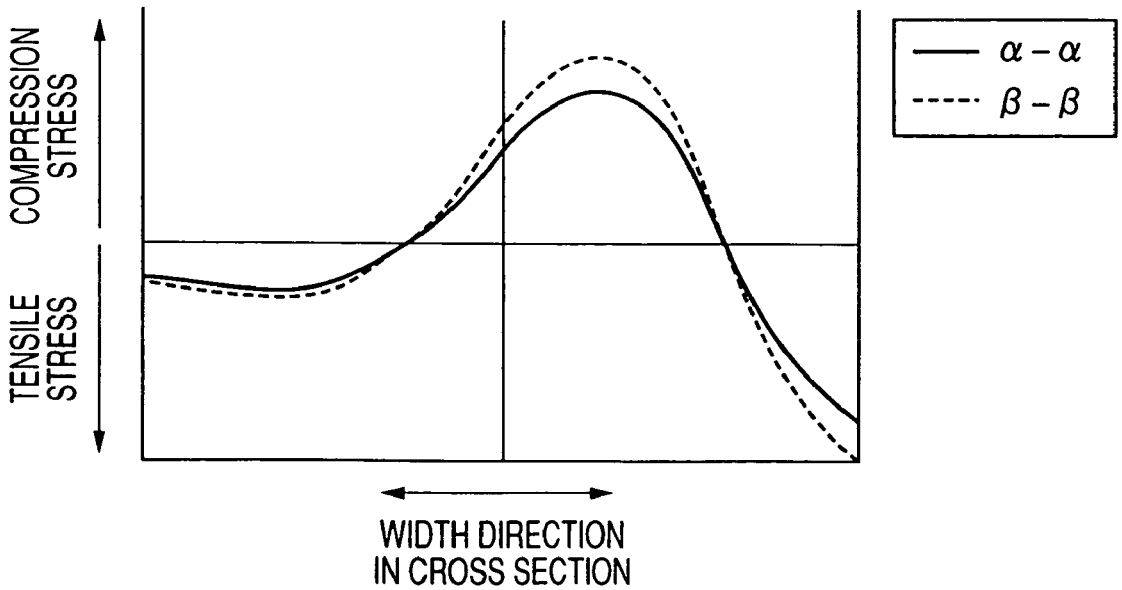

FIGS. 14A and 14B show a thermal stress distribution in the cross section in the direction of width of the heater 900, in case of a thermal uncontrollable state of the heater 900 in the fixing apparatus in which the heater 900 is incorporated in the heater drive circuit 70 shown in FIG. 13A, caused by a failure in one of the triacs 72*a* and 72*b*.

At first, in case of a thermal uncontrollable of the convex type heat generating patterns 901*a* by a failure of the triac 72*a*, the absolute tensile stress became maximum at both ends A1 of the α-α cross section in FIG. 12C and reached 225 MPa after 3 seconds from the start of application of 140 V. In a verification in which the current supply is continued to the heat generating pattern 901*a* without the temperature control from a normal temperature (24° C.) of the heater, the time from the start of current supply to the heater breakage was 8 seconds and the heater 900 broke before the function of the thermo switch 60.

Also in case of a thermal uncontrollable of the concave type heat generating pattern 101*b* by a failure of the triac 72*b*, the absolute tensile stress became maximum at both ends A2 of the β-β cross section in FIG. 12C and reached 225 MPa after 3 seconds from the start of application of 140 V. In a verification in which the current supply is continued to the heat generating pattern 901*b* without the temperature control from a normal temperature (24° C.) of the heater, the time from the start of current supply to the heater breakage was 8 seconds and the heater 900 broke before the function of the thermo switch 60.

As explained in the foregoing, the present example can significantly relax the thermal stress in a thermal uncontrollable state of the heat generating pattern in comparison with the comparative example, thereby securing a margin to the heat breakage. This is principally based on a level of symmetry of positioning of the heat generating patterns with respect to the approximate shorter side center CL of the substrate, and, in contrast to the prior plural heat generating patterns which are provided asymmetrically, the two heat generating patterns on a same conductive path are positioned at an edge side and at the other edge side in the direction of width of the substrate while a heat generating pattern on the other conductive path is positioned therebetween as described in the present example, whereby a symmetry of heat generation is secured with respect to the approximate shorter side center CL of the substrate when either pattern is energized. In this manner it is rendered possible to improve the durability and the reliability of the heater, and to improve the quality and the reliability of the fixing apparatus.

Stated differently, as the image heating apparatus includes "a substrate and plural heat generating resistors formed along a longitudinal direction of the substrate", and plural switching elements connected between a power source and the plural heat generating elements; wherein the plural heat generating resistors include at least two first heat generating resistors driven by a first switching element, and at least one of a second heat generating resistor driven by a second switching element, and the second heat generating resistor is provided, in a shorter side direction of the substrate, between the at least two first heat generating resistors, it is rendered possible to improve the durability of the heater and to suppress a breakage of the heater before the function of the safety element.

It is also possible to reduce a temperature elevation in a sheet non-passing area and to secure the fixing property at the same time, in case the first heat generating resistors driven by the first switching element and the second heat generating resistor have different heat generating distributions.

Figure 5A:
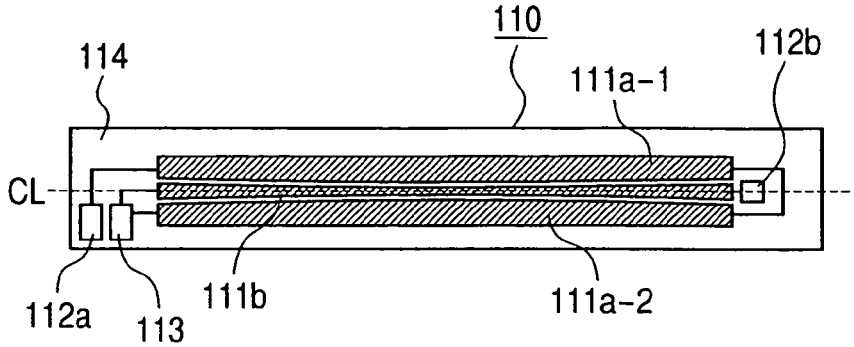
FIGS. 5A and 5B are views showing another heater configuration in Example 1.

The example 1 has explained a case of positioning the heat generating patterns of a convex heat generating distribution on both edge sides in the direction of width of the substrate and the heat generating pattern of a concave heat generating distribution in an internal side, but similar effects can be obtained also in a heater 110 shown in FIG. 5A in which the first heat generating patterns have a concave heat generating distribution and the second heat generating pattern has a convex heat generating distribution.

Figure 5B:
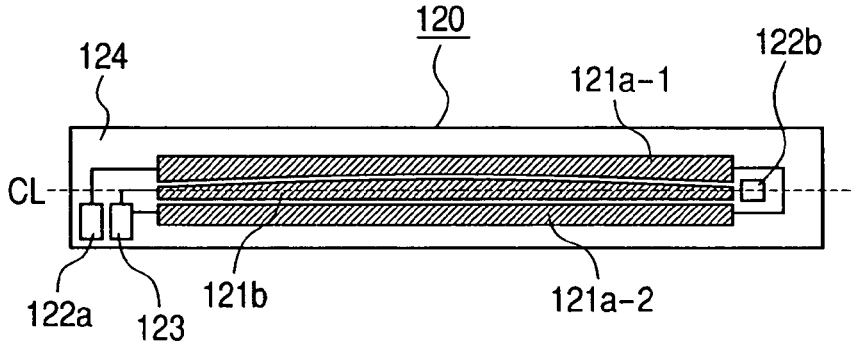

Also the example 1 has shown a positioning of the heat generating patterns completely symmetrical in the direction of width of the substrate, but such configuration is not restrictive and effects of a certain level can be obtained also in a configuration that is not completely symmetrical in the direction of width (shorter side direction) of the substrate, as long as heat generating patterns of a same conductive path are positioned at an edge side and at the other edge side in the shorter side direction of the substrate while a heat generating pattern on the other conductive path is positioned therebetween in the shorter side direction of the substrate. Thus, a heater 120 as shown in FIG. 5B, having somewhat different heat generating distributions on an edge side and another edge side in the direction of width of the substrate, can achieve a symmetry in the heat generation in comparison with the configuration of the comparative example, thereby not significantly reducing the margin to the heater breakage.

Also the first heat generating resistors are required to be present in at least two units, and may be present in three or more units. The second heat generating resistor is required to be present in at least one unit, and may be present in two or more units.

EXAMPLE 2

The effects of the example 1 can also be attained in a configuration of example 2 shown in the following.

Figure 6A:
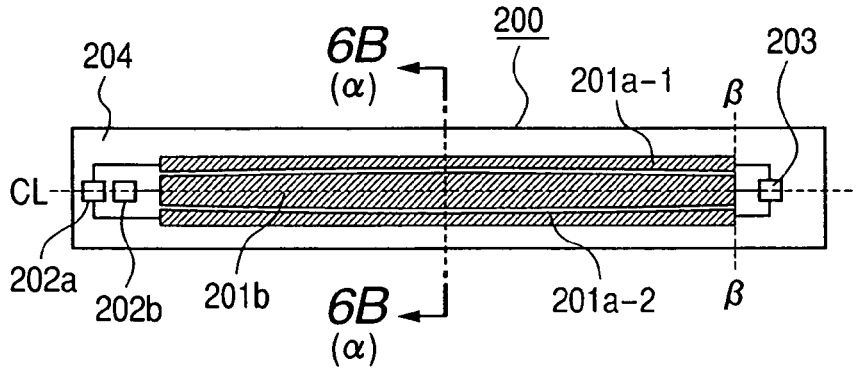
FIGS. 6A and 6B are schematic views showing a configuration of a heater 200 in Example 2.
Figure 6B:
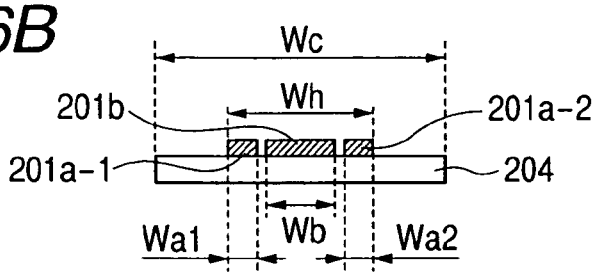

FIGS. 6A and 6B schematically illustrate a configuration of a heater 200 of the present example 2. The heater 200 is provided with heat generating patterns 201*a*-1, 201*a*-2 (first heat generating resistors) on both edge sides in the direction of width (shorter side direction) of a heater substrate 204, and a heating generating pattern 201*b* (second heat generating resistor) therebetween. Among these heat generating patterns 201*a*-1, 201*a*-2 and 201*b*, the heat generating patterns 201*a*-1, 201*a*-2 are mutually connected in parallel to constitute a first conductive path between a current supply electrode 202*a* and a common electrode 203. The heat generating pattern 201*b* constitutes a second conductive path between a current supply electrode 202*b* and the common electrode 203. The heat generating patterns 201*a*-1, 201*a*-2 (first heat generating resistors) are driven by a triac 72*a* (first switching element) shown in FIG. 7, and the heating generating pattern 201*b* (second heat generating resistor) is driven by a triac 72*b* (second switching element).

The heat generating patterns 201*a*-1, 201*a*-2 are widened in the pattern width in plural steps from approximate center to both ends in the longitudinal direction, as in the example 1, to gradually reduce the resistance per unit length in the longitudinal direction, thereby constituting a convex type heat generation pattern. In the heat generating patterns 201*a*-1, 201*a*-2, a resistance per unit length in the longitudinal direction in the vicinity of a line α-α in FIG. 6A is 1.2 times of a resistance per unit length in the longitudinal direction in the vicinity of a line β-β close to the end portions.

The heat generating pattern 201*b* is made narrower in the pattern width in plural steps from approximate center to both ends in the longitudinal direction to gradually increase the resistance per unit length in the longitudinal direction, thereby constituting a concave type heat generation pattern. In the heat generating pattern 201*b*, a resistance per unit length in the longitudinal direction in the vicinity of a line β-β in FIG. 6A is 1.2 times of a resistance per unit length in the longitudinal direction in the vicinity of a line α-α.

The heat generating patterns 201*a* and 201*b* are set at a resistance of Ra=20 Ω (because of a parallel connection, Ra1=Ra2=40 Ω) and Rb=20 Ω, so that each heat generating pattern generates a power of 720 W under an application of 120 V. With such resistance setting, each heat generating pattern can be prepared with a same composition by selecting the pattern widths FIG. 6B, for example Wa1=Wa2=1 mm, Wb=2 mm and a pattern gap of 0.5 mm.

Also as shown in FIG. 6B, an area Wh of the heat generating patterns 201*a* and 201*b* is formed substantially symmetrically to the center CL of the width Wc of the heater substrate 204, with such a width as to be contained in the fixing nip N. In the present example, there are selected Wc=10 mm and Wh=5 mm.

In the example 2, the relation between Wa1, Wa2 and Wb is different from that in the example 1. As the heat generating patterns 201*a*-1, 201*a*-2, formed on both edges sides of the heater substrate 204, are connected in parallel to constitute a single conductive path, in order to obtain a power same as in the example 1, each of the heat generating patterns 201*a*-1, 201*a*-2 has a resistance higher than in the example 1 (Ra1=Ra2=10Ω in example 1, and Ra1=Ra2=40Ω in example 2). It is therefore possible set Wa and Wb in FIG. 6B at about ½ of Wb (Wa and Wb in example 1 being at about 2 times of Wb).

Figure 7:
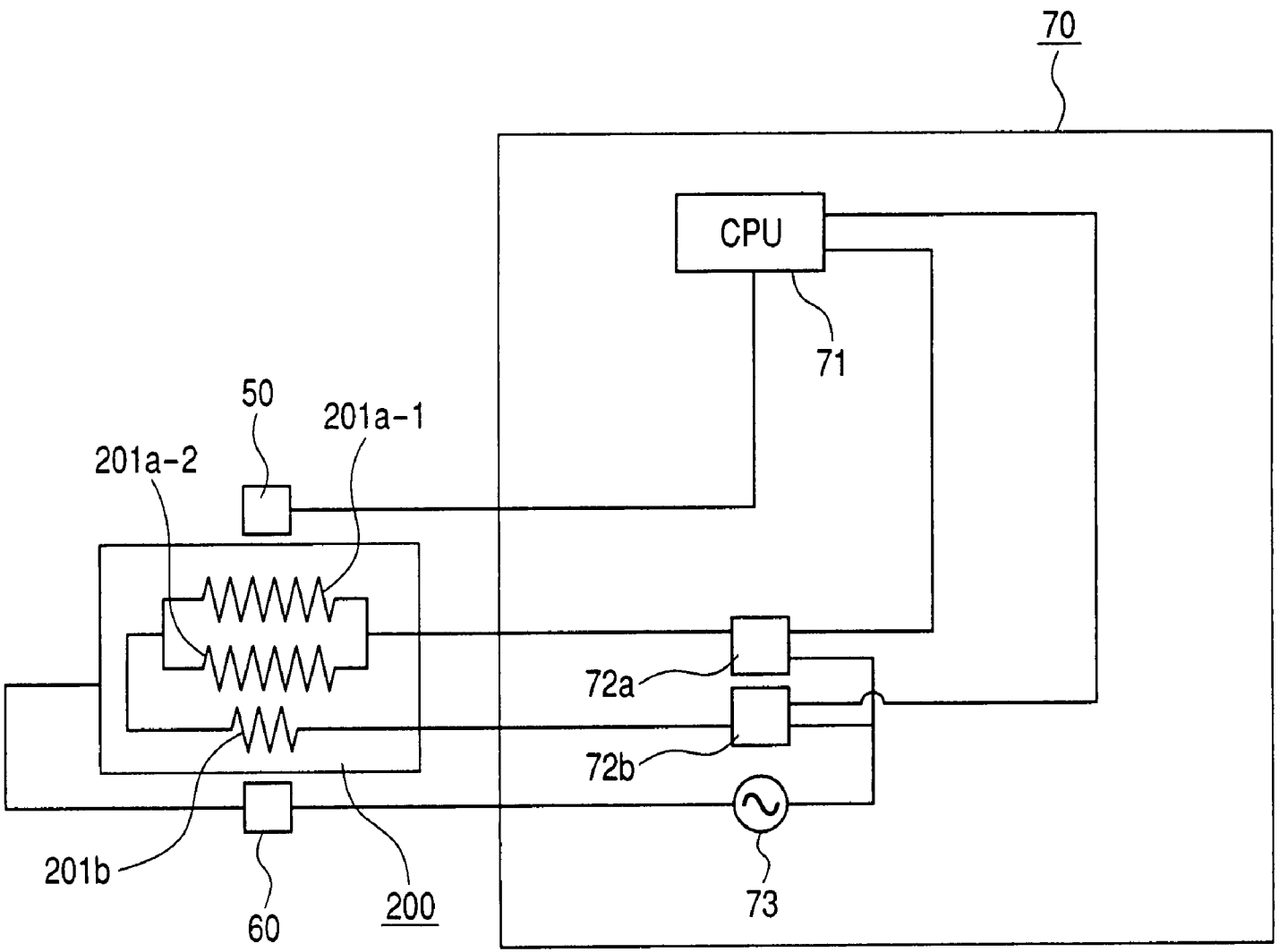
FIG. 7 is a circuit diagram showing a heater driving circuit employing the heater 200 in Example 2.
Figure 8A:
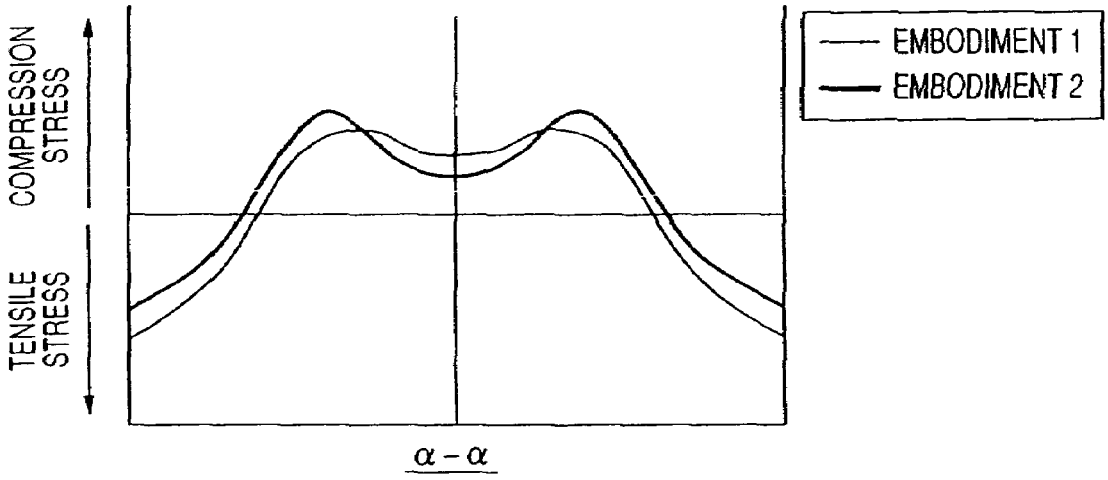
FIGS. 8A and 8B are charts showing thermal stress distribution in a thermal uncontrollable state in Example 2.
Figure 8B:
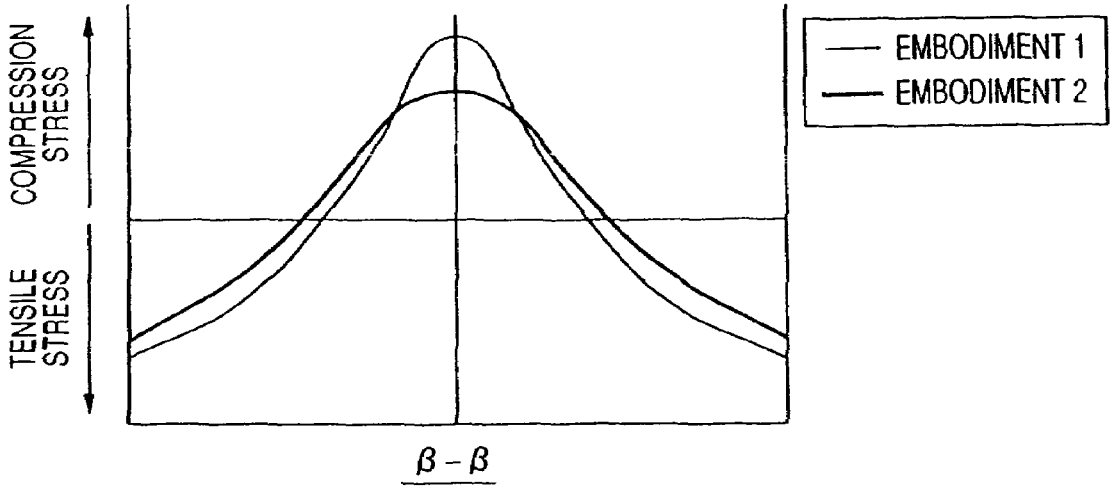

FIGS. 8A and 8B show a thermal stress distribution in the cross section in the direction of width of the heater 200, in case of a thermal uncontrollable state of the heater 200 in the fixing apparatus in which the heater 200 is incorporated in the heater drive circuit 70 shown in FIG. 7, caused by a failure in one of the triacs 72*a* and 72*b*.

With the heat generating patterns 201*a*-1, 201*a*-2 formed on both edge sides in the direction of width of the substrate 204 have pattern widths Wa1, Wa2 narrower than those in the example 1, as in the case of parallel connection of the two first heat generating resistors in the present example, in case of a thermal uncontrollable state of the heater 200 by a failure of the triac 72*a*, the temperature elevation is suppressed in a central portion in the direction of width of the substrate but is promoted on both edge portions in the direction of width of the substrate to provide a thermal stress distribution as shown in FIG. 8A, whereby the tensile stress applied to the both edges in the direction of width of the substrate of the heater 200 has a maximum value smaller than in the example 1.

Also with the heat generating pattern 201*b*, formed inside the heat generating patterns 201*a*-1, 201*a*-2 has a pattern width Wb larger than that in the example 1, in case of a thermal uncontrollable state of the heater 200 by a failure of the triac 72*b*, the temperature elevation is suppressed in a central portion in the direction of width of the substrate but is promoted on both edge portions in the direction of width of the substrate to provide a thermal stress distribution as shown in FIG. 8B, whereby the tensile stress applied to the both edges in the direction of width of the substrate of the heater 200 has a maximum value smaller than in the example 1.

Table 1 summarizes results of verification in the examples 1 and 2 and in the comparative example, showing, in case of a thermal uncontrollable state of each of the convex type heat generating pattern and the concave type heat generating pattern with a power of 980 W, a maximum tensile stress after 3 seconds from the start of the uncontrollable, presence/absence of the heater breakage in the thermal uncontrollable (time of breakage in the absence of safety element 60) and presence/absence of the function of the safety element 60.

TABLE 1

| verification of uncontrollable at 980 W | | example 1 | example 2 | comp. ex. |
|---|---|---|---|---|
| convex type heat generation pattern | max. tensile stress after 3 seconds | 106 MPa | 100 MPa | 225 MPa |
| | heater breakage (breaking time without safety element) | not broken (16 seconds) | not broken (17 seconds) | broken (8 seconds) |
| | safety element | operated | operated | not operated |
| concave type heat generation pattern | max. tensile stress after 3 seconds | 172 MPa | 165 MPa | 225 MPa |
| | heater breakage | not broken (12 seconds) | not broken (13 seconds) | broken (8 seconds) |
| | safety element | operated | operated | not operated |

By connecting the heat generating patterns on both edge sides in the direction of width of the heater substrate, namely two first heat generating resistors, in parallel as in the example 2 to constitute a single conductive path, it is rendered possible to further reduce the tensile stress in a uncontrollable state in either heating generating pattern thereby increasing the margin to the heater breakage.

EXAMPLE 3

The effects of the examples 1 and 2 can also be attained in a configuration of example 3 shown in the following.

In the examples 1 and 2, there have been explained a fixing apparatus having a reference position of sheet passing at the center of the longitudinal direction and a heater provided therein. The present example 3 shows an embodiment of a fixing apparatus having a reference position of sheet passing provided at an end portion (longitudinal end) in the longitudinal direction (direction perpendicular to the conveying direction c of the recording material P), and a heater to be provided therein.

Figure 9:
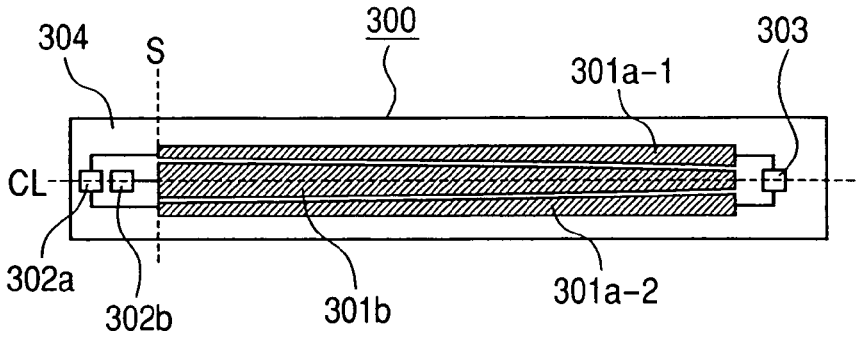
FIG. 9 is a schematic view showing a configuration of a heater 300 in Example 3.

FIG. 9 shows a heater configuration to be provided in a fixing apparatus having a reference position of sheet passing at a longitudinal end portion. Configurations other than the heater configuration are same as those in the examples 1 and 2. The heater 300 is provided with heat generating patterns 301*a*-1, 301*a*-2 (first heat generating resistors) on both edge sides in the direction of width (shorter side direction) of a heater substrate 304, and a heating generating pattern 301*b* (second heat generating resistor) therebetween. Among these heat generating patterns 301*a*-1, 301*a*-2 and 301*b*, the heat generating patterns 301*a*-1, 301*a*-2 are mutually connected in series or in parallel (parallel in the present example) to constitute a first conductive path between a current supply electrode 302*a* and a common electrode 303. The heat generating pattern 301*b* constitutes a second conductive path between a current supply electrode 302*b* and the common electrode 303. The heat generating patterns 301*a*-1, 301*a*-2 (first heat generating resistors) are driven by a first switching element, and the heating generating pattern 301*b* (second heat generating resistor) is driven by a second switching element.

In the present example 3, the heat generating patterns 301*a* (301*a*-1, 301*a*-2) are widened in the pattern width in plural steps from a longitudinal end (sheet passing reference side S) toward the other end, to gradually reduce the resistance per unit length in the longitudinal direction, thereby gradually decreasing the heat generation amount, in case of a current passing, from a predetermined reference position in the longitudinal direction of the substrate 104, namely from the sheet passing reference side S, toward the other end. On the other hand, the heat generating pattern 301*b* is made narrower in the pattern width in plural steps to gradually increase the resistance per unit length in the longitudinal direction, thereby gradually increasing the heat generation amount, in case of a current passing, from the sheet passing reference side S, toward the other end.

The configuration of the present example 3 allows, in the fixing apparatus having a reference position of sheet passing at a longitudinal end, to reduce the thermal stress applied to the heater, thereby securing a margin to the heater breakage at a uncontrollable situation of the fixing apparatus. It is also possible to reduce a temperature elevation in a sheet non-passing area and to secure the fixing property at the same time, since the first heat generating resistors and the second heat generating resistor have different heat generating distributions.

The present invention is not limited to the examples 1-3 explained in the foregoing but is subject to any and all modifications within the technical concept of the invention.

Figure 10A:
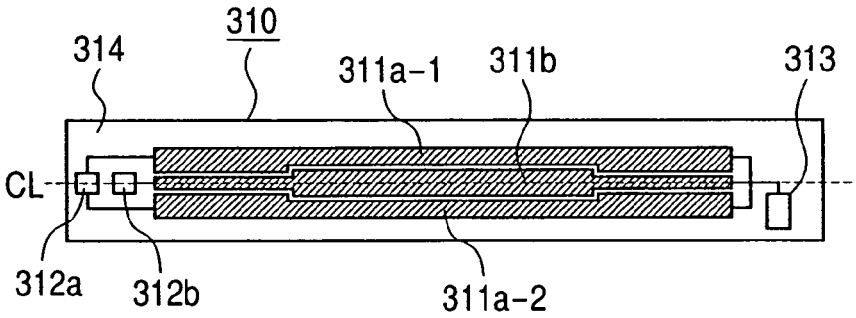
FIGS. 10A, 10B and 10C are views showing another heater configuration in the present invention.

For example, in the examples of the invention, a distribution in the heat generation in the longitudinal direction is formed by regulating the width of each heat generating pattern, but such distribution may also be formed by varying a thickness of the pattern or a composition of the material of the heat generating resistor in the longitudinal direction. Also the distribution of the heat generation in the longitudinal direction need not necessarily be a smooth change but can also be a stepwise changing distribution (FIG. 10A).

Figure 10B:
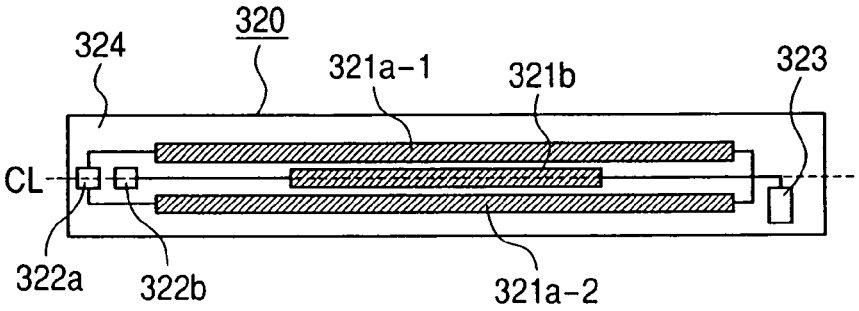

The present invention may also be applicable to a configuration in which the first heat generating resistors and the second heat generating resistor have different lengths in the heat generating resistor, thereby capable of switching the heat generating distribution of the heater (FIG. 10B).

Figure 10C:
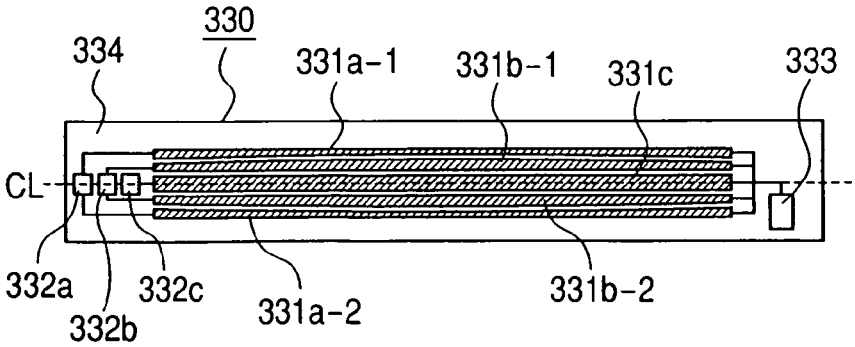

Also a heater having three or more independent conductive paths can be realized within the technical concept of the invention (FIG. 10C).

Also the heater substrate is not limited to alumina but can be prepared with various ceramic materials such as aluminum nitride, and the heat generating pattern may be formed on either of a top surface and a bottom surface.

In the following there will be explained other examples of the present invention.

EXAMPLE 4

Figure 15:
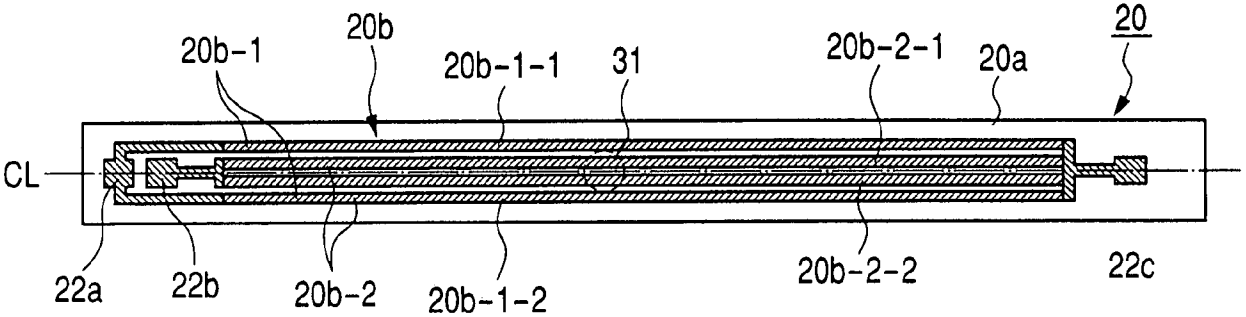
FIG. 15 is a schematic plan view of a top side of a heater of Example 4 in a state where a surface protective layer is removed.

FIG. 15 is a schematic plan view of a top side of a heater in a state where a surface protective layer, covering the heat generating resistors, is removed. In the present example, as in the examples 1-3, the second heat generating resistor is provided, in the shorter side direction of the substrate, between at least two first heat generating resistors. Also in the present example, each of the first and second heat generating resistors is constituted of two resistors.

A heater substrate 20*a* is a laterally oblong thin plate member formed by a ceramic material having a heat resistance, a high thermal conductivity and an electrical insulating property, such as alumina or aluminum nitride.

The substrate 20*a* is provided with plural heat generating resistors 20*b* in substantially symmetrical manner with respect to the approximate center in the shorter side direction of the substrate.

The heat generating resistors 20*b* are constituted of a pair of main heat generating resistors 20*b*-1 (first heat generating resistors), and a pair of sub heat generating resistors 20*b*-2 (second heat generating resistors). The paired main heat generating resistors 20*b*-1 includes a heat generating resistor (20*b*-1-1) and a heat generating resistor (20*b*-1-2), which are provided in symmetrical positions with respect to the approximate shorter side center CL of the substrate. The paired sub heat generating resistors includes a heat generating resistor (20*b*-2-1) and a heat generating resistor (20*b*-2-2), which are provided in symmetrical positions with respect to the approximate shorter side center CL of the substrate. Each of the main and sub paired heat generating resistors 20*b*-1, 20*b*-2 is formed, on a surface of the substrate 20*a*, with a thickness of about 0.5 μm by printing and calcining a conductive thick film paste such as of Ag/Pd by a thick film printing method (screen printing method). In the direction of width (shorter side direction) of the substrate, the heat generating resistors at edge portions of the substrate constitute the main heat generating resistors while those at the central portion constitute the sub heat generating resistors, and each of the main and sub paired heat generating resistors is formed by connecting plural heat generating resistors in parallel. Also the electrodes on both electrical ends of the heat generating resistor (20*b*-1-1) and the heat generating resistor (20*b*-1-2) of the main paired heat generating resistors in symmetrical positions with respect to the approximate shorter side center CL of the substrate constitute common electrodes 22*a*, 22*c*. Also in the sub paired heat generating resistors, the electrodes on both electrical ends of the heat generating resistor (20*b*-2-1) and the heat generating resistor (20*b*-2-2) constitute common electrodes 22*b*, 22*c*. The common electrode 22*c* serves for both the main paired heat generating resistors and the sub paired heat generating resistors.

Each of the four heat generating resistors have a resistance of 18 Ω.

Figure 16:
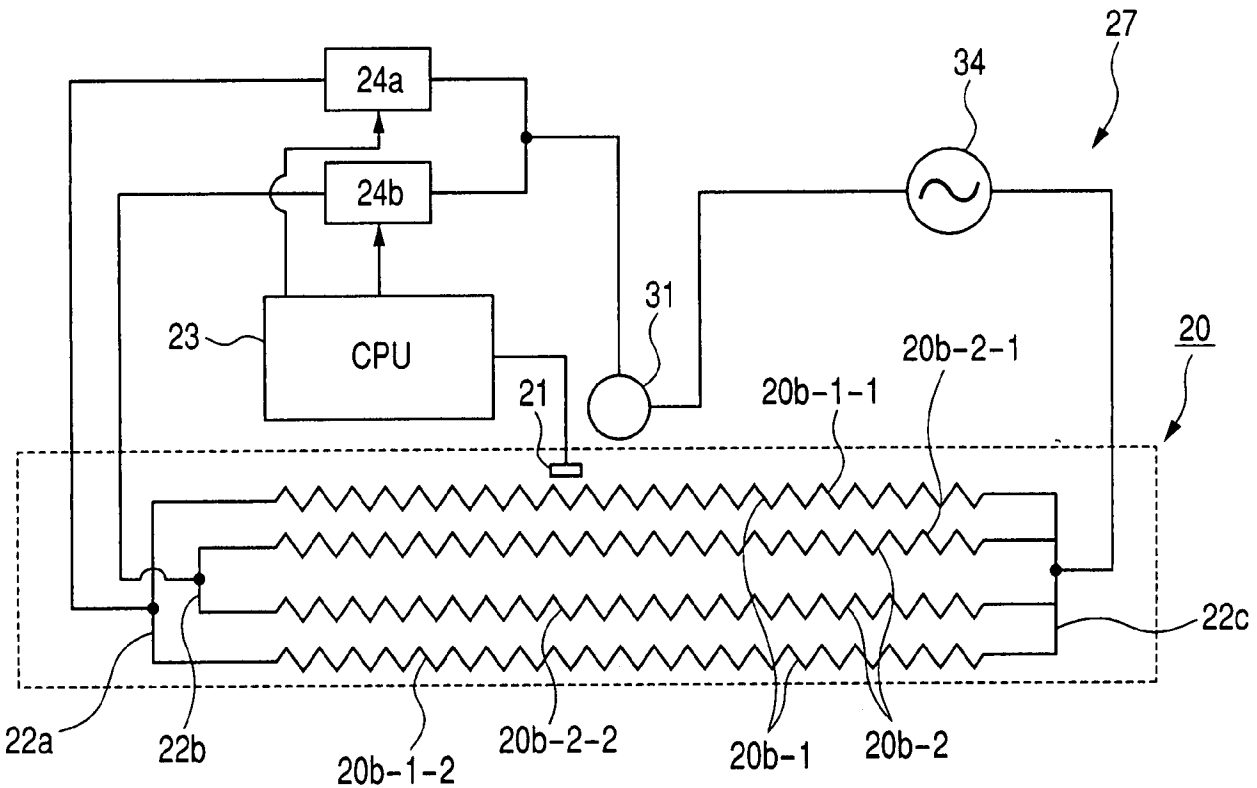
FIG. 16 is a circuit diagram of a heater driving circuit employing the heater of Example 4.

FIG. 16 is a block diagram of an electrical circuit of temperature control means 27 for the heater 20.

The temperature control means 27 is provided with a temperature detector 21, triacs 24 (24*a*, 24*b*) and a temperature controller (CPU) 23. The main power supply electrode 22*a* and the sub power supply electrode 22*b* of the main heat generating resistors 20*b*-1 the sub heat generating resistors 20*b*-2 are respectively connected to a triac 24*a* (first switching element) and a triac 24*b* (second switching element) for controlling an AC current from a commercial power supply 34. Also in series with the commercial power supply 34, there is connected a safety element (temperature fuse or thermo switch) 31 for preventing the excessive temperature elevation of the heater 20. The safety element 31 is positioned in contact with the heater 20 or in the vicinity thereof. The temperature controller controls the heater 20 at a predetermined temperature (target temperature) by controlling the on/off timing of the triacs 24*a*, 24*b* based on the temperature detected by the temperature detector 21, thereby controlling the current supply by the triac 24*a* to the paired main heat generating resistors 20*b*-1 between the main power supply electrode 22*a* and the common electrode 22*c* and the current supply by the triac 24*b* to the paired sub heat generating resistors 20*b*-2 between the main power supply electrode 22*b* and the common electrode 22*c*.

In the following there will explained a configuration of resistors in a heater 50 of a comparative example. FIG. 24 is a schematic plan view of a top side of the heater 50 of the comparative example.

The heater 50 of the comparative example shown in FIG. 24 is provided, on a surface of a ceramic substrate 50*a*, with a main heat generating resistor 50*b*-1 and a sub heat generating resistor 50*b*-2, respectively at an edge side and another edge side in the shorter side direction of the substrate and along the longitudinal direction thereof. A current is supplied to the main heat generating resistor 50*b*-1 from a main current supply electrode 51*a* to a common electrode 51*c*, and a current is supplied to the sub heat generating resistor 50*b*-2 from a sub current supply electrode 51*b* to the common electrode 51*c*. Also a thermo switch 52 is provided.

In the comparative example, as explained above, the main and sub heat generating resistors 50*b*-1, 50*b*-2 are divided in an edge side and another edge side in the shorter side direction of the substrate.

On the other hand, in the present example, in the paired main heat generating resistors (20*b*-1) and the paired sub heat generating resistors (20*b*-2), the heat generating resistors (20*b*-1-1, 20*b*-1-2) and those (20*b*-2-1, 20*b*-2-2) are respectively provided at an edge side and another edge side in the shorter side direction of the substrate, symmetric to the approximate shorter side center CL of the substrate. Stated differently, the two second heat generating resistors (20*b*-2-1, 20*b*-2-2) are provided, in the shorter side direction of the substrate, between the two first heat generating resistors (20*b*-1-1, 20*b*-1-2).

Figure 17A:
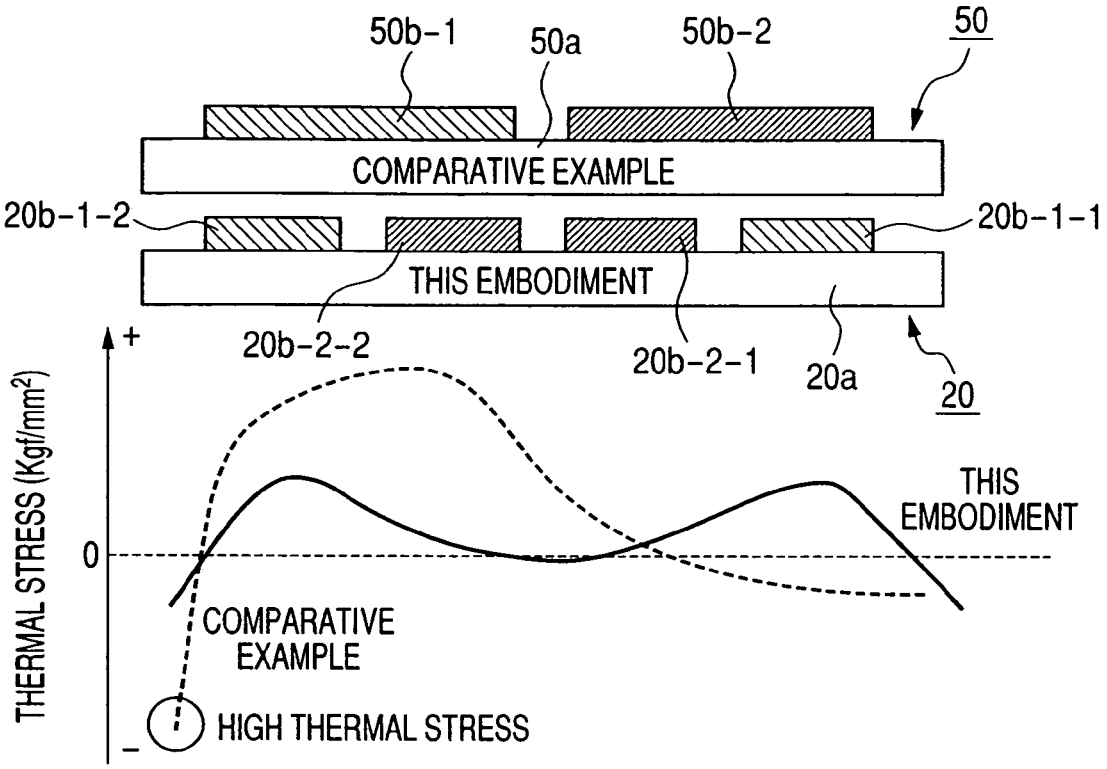
FIGS. 17A and 17B are charts showing comparison of thermal stress of the heater of Example 4 and the heater of the comparative example.
Figure 17B:
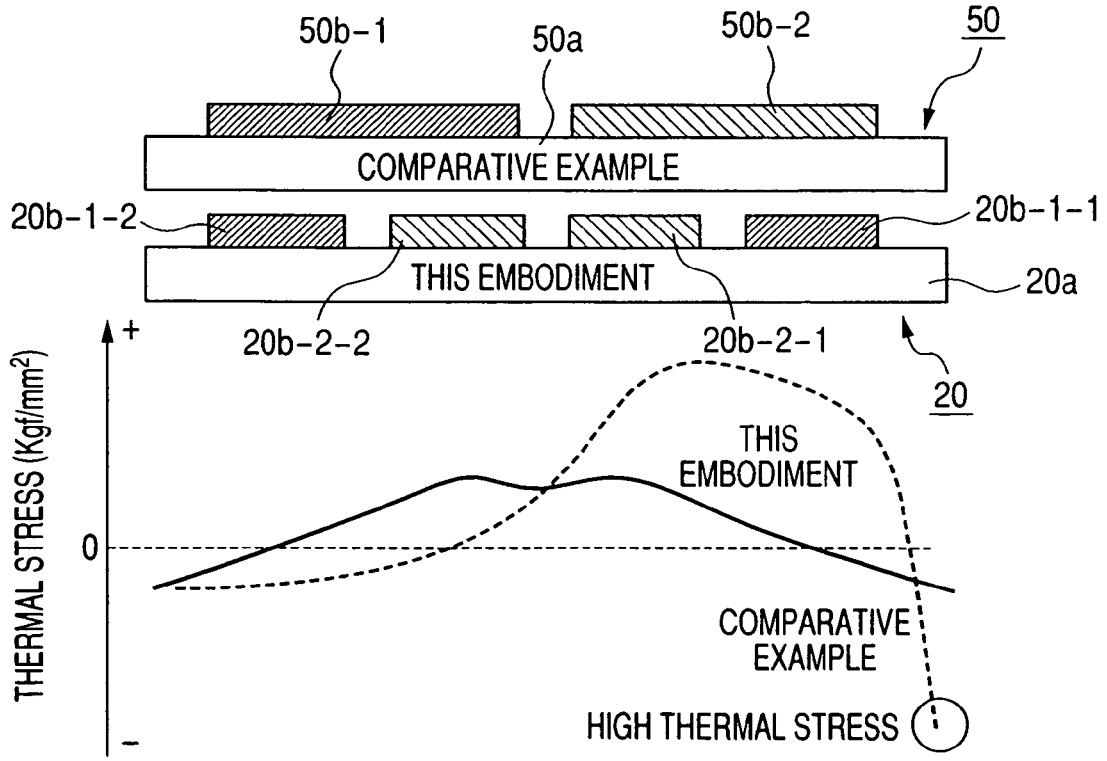

FIG. 17A shows a thermal stress when the paired main heat generating resistors 20*b*-1 are energized, and FIG. 17B shows a thermal stress when the paired sub heat generating resistors 20*b*-2 are energized, and FIGS. 17A and 17B respectively show cross sectional views of the heaters of the comparative example and the present example and a thermal stress distribution.

Comparison of the present example and the comparative example in FIGS. 17A and 17B indicates that the comparative example generates a large thermal stress particularly in the edge portions (both edge portions in the direction of width) of the substrate at the heat generating side, but the stress in the edge portion is alleviated in the present example. Thus the present invention can reduce the thermal stress generated at the edge portion of the substrate, thereby alleviating the burden caused by the thermal stress on the edge portion of the substrate.

Also FIG. 18 shows a time to the destruction of the heater and an operation time of the safety element in a thermal uncontrollable situation of each heat generating resistor.

The operation of the safety element 31 terminates the current supply to the main and sub heat generating resistors 20*b*-1, 20*b*-2, but, in this experiment, since the safety element 31 and the main and sub heat generating resistors 20*b*-1, 20*b*-2 are separately connected in this experiment, the power supply to the main and sub heat generating resistors 20*b*-1, 20*b*-2 is continued until the heater 20 is broken even after the function of the safety element 31.

Figure 19A:
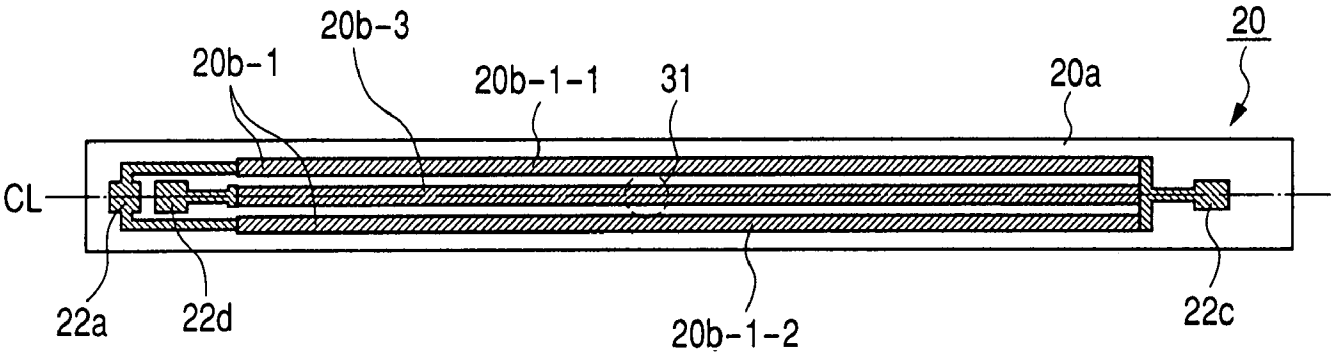
FIGS. 19A, 19B and 19C are schematic plan views of a top side of other examples of the heater of Example 4 in a state where a surface protective layer is removed.
Figure 19B:
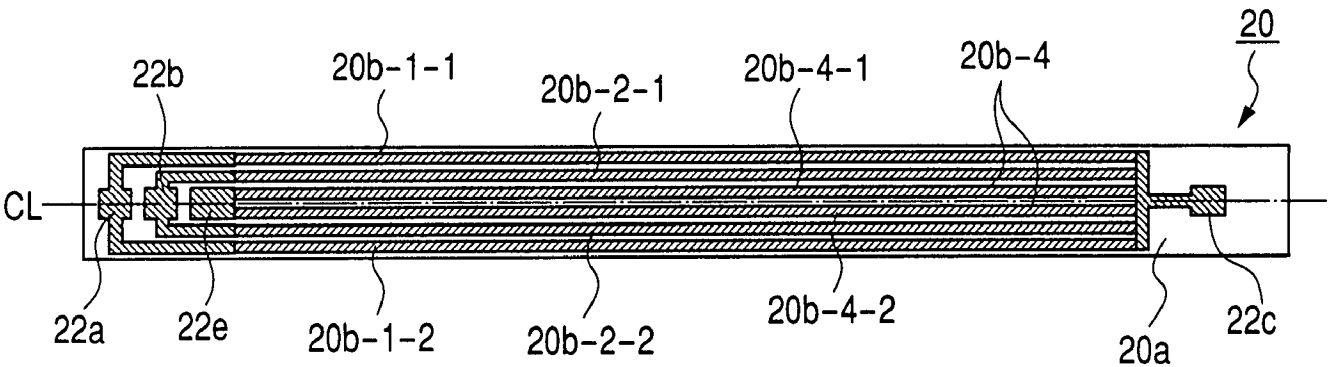
Figure 19C:
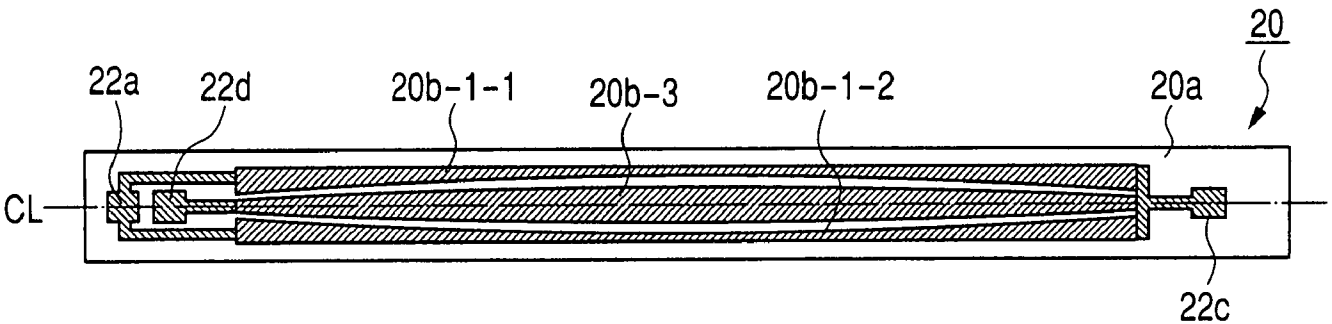

As shown in FIGS. 19A to 19C, in a thermal uncontrollable of the main heat generating resistor in the comparative example, the heater was broken at 3.5 seconds before the safety element was activated, but, in the present example, the safety element was operated (5.7 seconds) before the heater was broken (10 seconds). Similar results were obtained also in the thermal uncontrollable situation of the sub heat generating resistors.

Therefore, even when the heater 20 causes a thermal uncontrollable (abnormal temperature elevation or overheating) by a failure in the temperature controller 23, the safety element is operated to terminate the current supply to the heat generating resistor before the heater is broken. It is thus possible to improve the durability and the reliability of the heater 20.

The effects of the heater 20 shown in FIG. 15 can be also attained by the configuration of a heater 20 shown in FIGS. 19A to 19C.

FIGS. 19A to 19C are schematic plan views of a top side of a heater in a state where a surface protective layer is removed. Components equivalent to those in FIG. 15 will be represented by same symbols and will not be explained further.

In FIG. 19A, heat generating resistors 20*b* is constituted of paired main heat generating resistors (first heat generating resistors) 20*b*-1 (20*b*-1-1, 20*b*-1-2) and a sub heat generating resistor (second heat generating resistor) 20*b*-3. The sub heat generating resistor 20*b*-3 is provided between the main heat generating resistors (20*b*-1-1, 20*b*-1-2) and at the approximate shorter side center CL of the substrate. The sub heat generating resistor 20*b*-3 is provided with sub current supply electrode 22*d* as a common electrode at an electrical end at the side of the main current supply electrode 22*a* of the paired main heat generating resistors 20*b*-1. For the heater 20 shown in FIG. 19A, the temperature control means 27 shown in FIG. 16 can be employed as a secondary circuit.

In the heater 20 shown in FIG. 19A, the main heat generating resistor and the sub heat generating resistor have resistances of 14.5 Ω and 23 Ω, thus with a power ratio of about 3:2. In order to compensate for the deficiency in power for example under a low temperature environment, it is necessary to secure a total electric power in the paired main heat generating resistors 20*b*-1 and the sub heat generating resistor 20*b*-3, so that the electric power of the main heat generating resistors has to be increased in compensation for the reduction in the electric power of the sub heat generating resistor.

FIG. 20 shows a heat breaking time, a safety element operation time and a margin under a same condition. With resistances of the main/sub heat generating resistors of 1:1, the margin was insufficient (0.4 seconds) in a thermal uncontrollable of the sub heat generating resistor, but, when the resistances of the main/sub heat generating resistors were regulated to 2:3 (namely with a power ratio of 3:2), a sufficient margin (2.8 seconds) could be secured for the uncontrollable of the sub heat generating resistor though a margin was somewhat limited (3.6 seconds) for the uncontrollable of the main heat generating resistor. Naturally an appropriate distribution is variable depending for example on a width of the substrate, a thickness and an input voltage.

Also depending on the design conditions, the heat generating resistors 20*b* may be constituted of three or more heat generating resistors. An example is shown in FIG. 19B. The heat generating resistors 20*b* are constituted of heat generating resistors of three systems, namely paired main heat generating resistors (first heat generating resistors) 20*b*-1, paired first sub heat generating resistors (second heat generating resistors) 20*b*-2, and paired second sub heat generating resistors (third heat generating resistors) 20*b*-4. A heat generating resistor 20*b*-4-1 and a heat generating resistor 20*b*-4-2 constituting the paired second sub heat generating resistors 20*b*-4 are respectively provided at an edge side and another edge side of the shorter side direction of substrate and symmetrically to the approximate shorter side center CL between the first sub heat generating resistors (20*b*-2-1, 20*b*-2-2). The heat generating resistors (20*b*-4-1, 20*b*-4-2) have a sub current supply electrode 22*e* as a common electrode at an electrical end at the side of the main current supply electrode 22*b* of the paired first sub heat generating resistors 20*b*-2.

Figure 21:
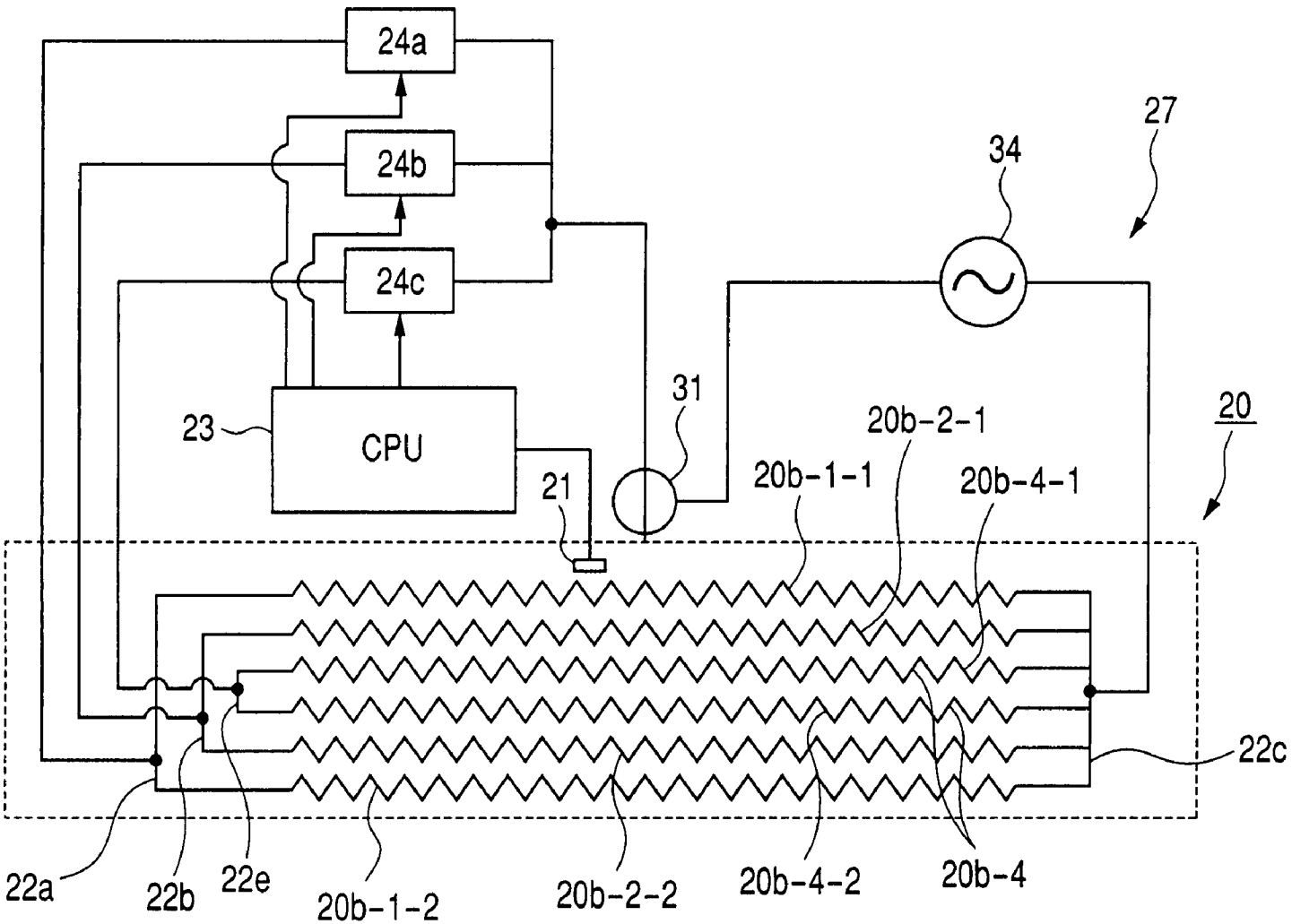
FIG. 21 is a circuit diagram of a heater driving circuit employing the heater of FIG. 19B.

For the heater 20 shown in FIG. 19B, the temperature control means 27 shown in FIG. 21 can be employed as a secondary circuit. Components equivalent to those in FIG. 21 will be represented by same symbols and will not be explained further.

In the paired main heat generating resistors 20*b*-1 and the first and second paired sub heat generating resistors 20*b*-2, 20*b*-4, the main current supply electrode 22*a* and the sub current supply electrodes 22*b*, 22*e* are respectively connected with a triac 24*a* (first switching element), a triac 24*b* (second switching element) and a triac 24*c* (third switching element) are for controlling the AC current from the commercial power supply 34. Also the common electrode 22*c* is connected through the commercial power supply 34 through a safety element (temperature fuse or thermo switch in the present example) for preventing an excessive temperature elevation of the heater 20. The safety element 31 is positioned in contact with the heater 20 or in the vicinity thereof. The temperature controller 23 controls the on/off timing of the triacs 24*a*, 24*b*, 24*c* based on the temperature detected by the temperature detector 21. Thus it controls the heater 20 at a predetermined temperature (target temperature) by controlling the current supply by the triac 24*a* to the paired main heat generating resistors 20*b*-1 between the main power supply electrode 22*a* and the common electrode 22*c*, the current supply by the triac 24*b* to the paired sub heat generating resistors 20*b*-2 between the main power supply electrode 22*b* and the common electrode 22*c*, and the current supply by the triac 24*c* to the paired sub heat generating resistors 20*b*-4 between the main power supply electrode 22*e* and the common electrode 22*c*. Thus in the present example, between the two first heat generating resistors 20*b*-1-1 and 20*b*-1-2, there are provided two second heat generating resistors 20*b*-2-1, 20*b*-2-2, between which provided are the two third heat generating resistors 20*b*-4-1, 20*b*-4-2.

Also the heater 20 shown in FIG. 19B, because of the symmetrical positioning of the heat generating resistors of three systems with respect to the approximate shorter side center CL of the substrate, can reduce the burden on the edge portions of the substrate by the thermal stress, whereby the heater is not broken by a thermal uncontrollable, in case of a thermal uncontrollable of the temperature controller 23.

The heater 20 shown in FIGS. 19A and 19B employs the linear main and sub heat generating resistors 20*b*-3 with a constant width, but the main and sub heat generating resistors are not limited to such configuration and there may be employed main/sub heat generating resistors of a tapered shape. An example of such configuration is shown in FIG. 19C.

In FIG. 19C, the main heat generating resistors (20*b*-1-1, 20*b*-1-2, first heat generating resistors) are widened in the width in plural steps from the longitudinal center to the ends while the sub heat generating resistors (second heat generating resistors) 20*b*-3 are made narrower in the width in plural steps from the longitudinal center to the ends. Also in this case, the main heat generating resistors (20*b*-1-1, 20*b*-1-2) and the sub heat generating resistor (20*b*-3) are positioned symmetrically at the approximate shorter side center CL of the substrate.

In the present example, no destruction occurs even in case the fixing apparatus 11 becomes by any reason incapable of controlling the current supply to the heater 20 whereby the electric power is continuously supplied to the heat generating resistor 20*b* of the AC line (primary circuit) to induce a thermal uncontrollable (abnormal temperature elevation or overheating) of the heater 20.

Since the heater 20 is not broken by the thermal uncontrollable, the safety element 31 such as a temperature fuse or a thermo switch inserted serially in the AC line is activated to open the AC line, whereby the power supply to the heat generating resistor 20*b* is intercepted and the thermal uncontrollable of the heater 20 is terminated.

EXAMPLE 5

The present example shows a configuration in which paired main heat generating resistors and a sub heat generating resistor are provided on top and rear surfaces of the ceramic substrate. Components equivalent to those in the example 4 are represented by same symbols and will not be explained further.

Figure 22A:
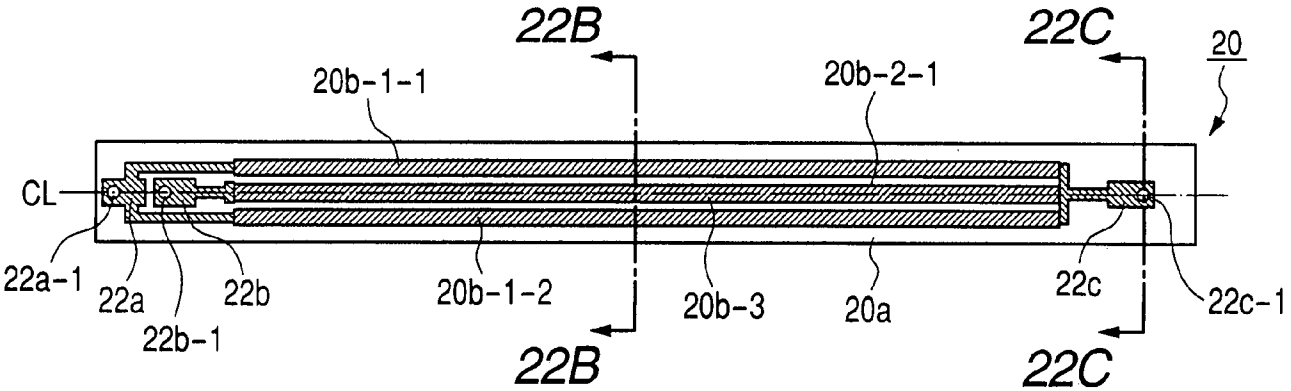
FIGS. 22A, 22B, 22C and 22D are schematic plan views of a top side of examples of heater of Example 5 in a state where a surface protective layer is removed.
Figure 22B:
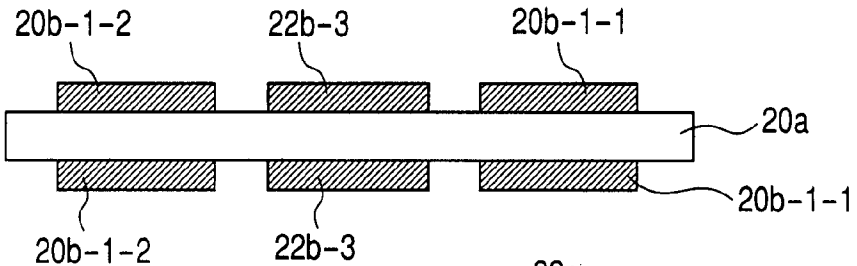
Figure 22C:
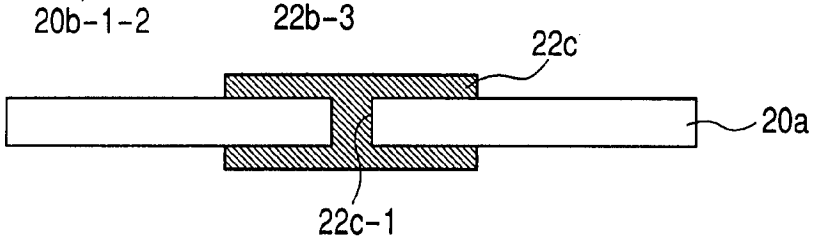

FIGS. 22A to 22D illustrate an example of the heater of the present example, wherein FIG. 22A is a schematic plan view of a top surface of the heater from which a surface protective layer is removed; FIG. 22B is a magnified cross-sectional view along a line 22B-22B in FIG. 22A; and FIG. 22C is a magnified cross-sectional view along a line 22C-22C.

In the present example, in order to further improve the durability of the heater, paired main heat generating resistors 20*b*-1 and a sub heat generating resistor 20*b*-3 are provided symmetrically on top and rear surfaces of a ceramic substrate 21*a*. As shown in FIGS. 22A and 22B, the main heat generating resistors 20*b*-1-1, 20*b*-1-2 are provided at an end portion and another end portion in the shorter side direction, symmetrical to the approximate shorter side center CL of the substrate. The main heat generating resistors 20*b*-1-1, 20*b*-1-2 have a main current supply electrode 22*a* and a common electrode 22*c* on electrical ends on the top and rear surfaces of the substrate 20*a*. On the other hand, the sub heat generating resistor 20*b*-2 is provided between the main heat generating resistors 20*b*-1-1, 20*b*-1-2 and at the approximate shorter side center of the substrate. The sub heat generating resistor 20*b*-2 is provided with a sub current supply electrode 22*b* at an electrical end at the side of the main current supply electrode 22*a* of the paired main heat generating resistors 20*b*-1.

Figure 22D:
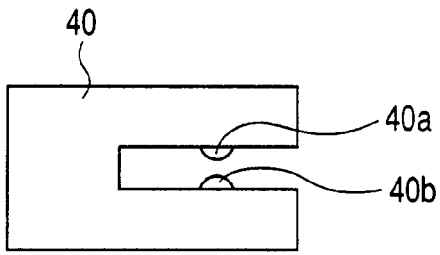

In case the main heat generating resistors 20*b*-1 and the sub heat generating resistors 20*b*-3 on the top and rear surfaces of the substrate are connected in parallel, it is possible to adopt connections by through holes 22*a*-1, 22*c*-1, 22*b*-1 via the substrate 20*a* in the electrodes 22*a*, 22*c*, 22*b* corresponding to the respective heat generating resistors (cf. FIG. 22C), or to adopt a connector 40 capable of forming a connection by the contacts 40*a*, 40*b* on the top and rear surfaces of the substrate 20*a* (cf. FIG. 22D).

In the present example, as the temperatures on the top and rear surfaces of the substrate 20*a* become approximately equal, the temperature distribution becomes always symmetrical to the approximate shorter side center CL even in a thick substrate 20*a*, whereby the thermal stress is canceled and is reduced drastically.

Figure 23A:
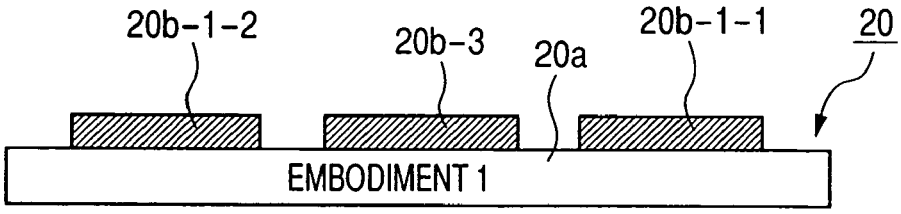
FIGS. 23A, 23B and 23C are cross sectional views in the width direction of the heaters of Examples 5 and 4 and charts showing comparison of thermal stress thereof.
Figure 23B:
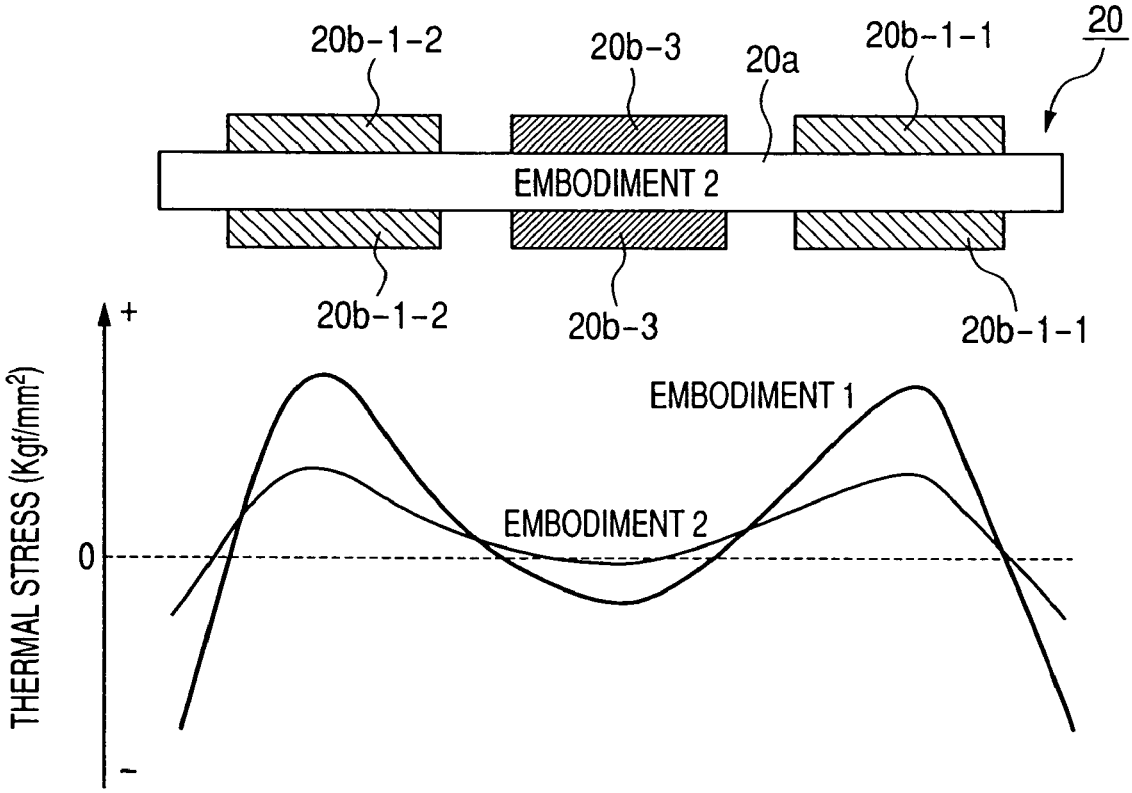
Figures 23C, 24:
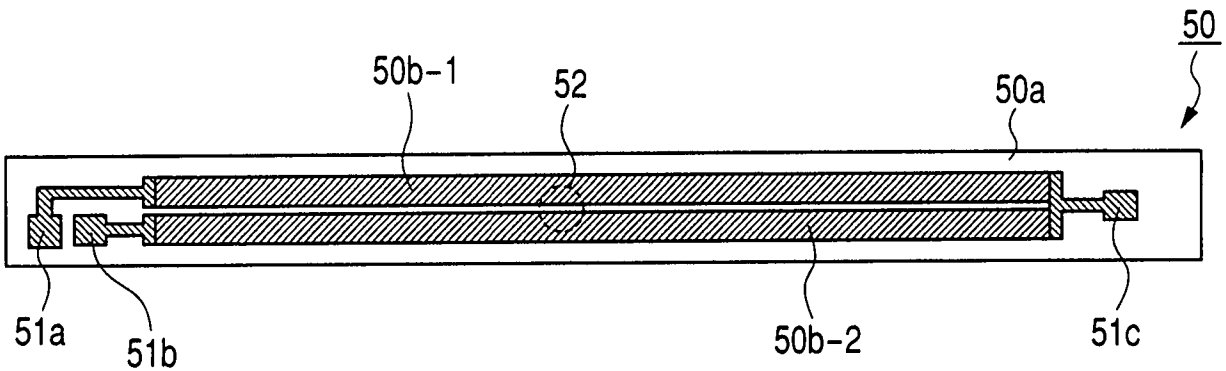
FIG. 24 is a schematic plan view of a top side of a heater of comparative example, in a state where a surface protective layer is removed.

FIGS. 23A to 23D show results of comparison of the thermal stresses in the heater of the example 4 and that of the example 5. FIG. 23A is a cross-sectional view in the direction of width of the heater 20 shown in FIG. 19A, while FIG. 23B shows a cross-sectional view in the direction of width of the heater of the example 5 and a chart showing thermal stress distributions of the heaters of the examples 4 and 5. FIG. 23C shows a time of breakage and an operating time of the safety element in the heaters of examples 4 and 5, in a uncontrollable situation of the heat generating resistor.

Referring to FIG. 23C, the breaking time of the heater is 8.2 seconds in the example 4 and 9.0 seconds in the example 5. Also the operation time of the safety element is 4.6 seconds in the example 4 and 3.4 seconds in the example 5. As a result, the operation margin of the safety element is increased from 3.6 seconds in the example 4 to 5.6 seconds in the example 5.

Therefore, in the heater of the present example, the time to the heater breakage becomes longer because of a reduced thermal stress generating in the direction of thickness of the substrate (elimination of the uneven temperature distribution), and the operation time of the safety element becomes extremely short because it is positioned closer to the heat generating resistor. It is thus possible to secure a sufficient margin, even better than in the example 1. Thus, also the present example can improve the durability and the reliability of the heater.

In the present example, the safety element 31 such as a temperature fuse or a thermo switch inserted serially in the AC line is activated to open the AC line before the heater 20 is broken by the thermal uncontrollable, whereby the power supply to the heat generating resistor 20*b* is intercepted and the thermal uncontrollable of the heater 20 is terminated.

As the safety element 31 is activated to intercept the power supply before the heater 20 is broken by the thermal uncontrollable, it is rendered possible to reduce also current leaks in AC and DC lines, a breakage in the current leakage/temperature control systems, and an erroneous operation of a computer resulting from such current leakage.

Also since the heater 20 is not broken even at a maximum power, the resistance of the heat generating resistor can be selected low.

It is thus possible to provide an image forming apparatus capable of increasing the process speed, in case of employing the image heating apparatus as a fixing apparatus including a heating member.

(Others)

a) In the examples 4 and 5, the pressure member constituting the pressure rotary member may be constituted of an endless member having an elastic member, instead of a roller member having an elastic member. Also a lower heat capacity may be achieved by employing a pressing film unit constituted of an endless belt and a pressure member disclosed in Japanese Patent Application Laid-open No. 2001-228731.

b) Also the fixing film as the other rotary member may be of a configuration supported and driven by a driving roller and a tension roller (film driving method).

In the foregoing, the present invention has been explained by various examples and embodiments, but it will be readily understood to those skilled in the art that the principle and extent of the invention are not limited to the specified description and the drawings of the present specification but include various modifications and alterations within the scope of the appended claims.

This application claims priority from Japanese Patent Application Nos. 2004-182418 filed Jun. 21, 2004 and 2004-182419 filed Jun. 21, 2004, which are hereby incorporated by reference herein.

What is claimed is:

1. An image heating apparatus for heating an image formed on a recording material, comprising:

a heater including a substrate and a plurality of heat generating resistors formed on said substrate along a longitudinal direction thereof; and a plurality of switching elements connected electrically between a power source and said plurality of heat generating resistors;

wherein said plurality of heat generating resistors include at least two first heat generating resistors driven by a first switching element and at least one of a second heat generating resistor driven by a second switching element, and said second heat generating resistor is provided between said first heat generating resistors in a direction of a shorter side of said substrate.

2. An image heating apparatus according to claim 1, wherein said first heat generating resistors are provided substantially symmetrically with respect to an approximate center in a shorter side direction of said substrate.

3. An image heating apparatus according to claim 2, wherein said second heat generating resistor is provided in one unit and is provided at the center.

4. An image heating apparatus according to claim 2, wherein said second heat generating resistors are provided in two units and are provided substantially symmetrically to the center.

5. An image heating apparatus according to claim 1, wherein said first heat generating resistor and said second heat generating resistor have different heat generation distributions.

6. An image heating apparatus according to claim 1, wherein said first and second heat generating resistors are formed on a top surface and a rear surface of said substrate.

7. An image heating apparatus according to claim 1, further comprising a flexible sleeve of which an internal surface is in contact with said heater, and a pressure roller for forming a nip portion with said heater through said flexible sleeve, wherein the recording material is heated while being pinched and conveyed in the nip portion.

8. A heater for use in an image heating apparatus, comprising:

a substrate; and a plurality of heat generating resistors formed on said substrate along a longitudinal direction thereof;

wherein said plurality of heat generating resistors include at least two first heat generating resistors driven by a first switching element of the image heating apparatus and at least one of a second heat generating resistor driven by a second switching element of the image heating apparatus, and said second heat generating resistor is provided between said first heat generating resistors in a direction of a shorter side of said substrate.

9. A heater according to claim 8, wherein said first heat generating resistors are provided substantially symmetrically with respect to an approximate center in a shorter side direction of said substrate.

10. A heater according to claim 9, wherein said second heat generating resistor is provided in one unit and is provided at the center.

11. A heater according to claim 9, wherein said second heat generating resistors are provided in two units and are provided substantially symmetrically to the center.

12. A heater according to claim 8, wherein said first heat generating resistor and said second heat generating resistor have different heat generation distributions.

13. A heater according to claim 8, wherein said first and second heat generating resistors are formed on a top surface and a rear surface of said substrate.

* * * * *

UNITED STATES PATENT AND TRADEMARK OFFICE

CERTIFICATE OF CORRECTION

PATENT NO. : 7,283,145 B2
APPLICATION NO. : 11/154545
DATED : October 16, 2007
INVENTOR(S) : Akira Kato et al.

It is certified that error appears in the above-identified patent and that said Letters Patent is hereby corrected as shown below:

ON THE COVER PAGE
At Item (56), U.S. Patent Documents, "5,663,696 A 9/1997 Morgan" should read --5,563,696 A 10/1996 Futugawa et al.--.

COLUMN 2
Line 9, "determine" should read --determining--.

COLUMN 4
Line 18, "is" should read --is to--.
Line 25, "respect" should read --respect to--.

COLUMN 8
Line 7, "a electrical" should read --an electrical--.

COLUMN 9
Line 65, "case a" should read --case an--.

COLUMN 14
Line 4, "possible" should read --possible to--.

COLUMN 15
Line 5, "a" should read --an--.
Line 62, "at a" should read --at an--.

Signed and Sealed this

Seventeenth Day of June, 2008

JON W. DUDAS
*Director of the United States Patent and Trademark Office*